US006980203B2

(12) United States Patent
Ota

(10) Patent No.: US 6,980,203 B2
(45) Date of Patent: Dec. 27, 2005

(54) DISPLAY DRIVER CIRCUIT, ELECTRO-OPTICAL DEVICE, AND DISPLAY DRIVE METHOD

(75) Inventor: Yusuke Ota, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 316 days.

(21) Appl. No.: 10/313,982

(22) Filed: Dec. 5, 2002

(65) Prior Publication Data

US 2003/0156103 A1 Aug. 21, 2003

(30) Foreign Application Priority Data

Dec. 5, 2001 (JP) ..... 2001-371472

(51) Int. Cl.[7] ..... G09G 5/00

(52) U.S. Cl. ..... 345/204; 345/55; 345/87; 345/88; 345/94; 345/206

(58) Field of Search ..... 345/55, 87–89, 345/94, 204, 206

(56) References Cited

U.S. PATENT DOCUMENTS

| | | | | |
|---|---|---|---|---|
| 4,712,175 | A * | 12/1987 | Torii et al. | 712/4 |
| 5,182,727 | A * | 1/1993 | McFalls et al. | 365/230.06 |
| 6,075,509 | A * | 6/2000 | Ellis et al. | 345/98 |
| 6,630,920 | B1 * | 10/2003 | Maekawa et al. | 345/100 |
| 6,727,879 | B2 * | 4/2004 | Sako | 345/98 |
| 2002/0158832 | A1 * | 10/2002 | Park et al. | 345/98 |

FOREIGN PATENT DOCUMENTS

| | | |
|---|---|---|
| JP | 06-332409 | 12/1994 |
| JP | 09-016117 | 1/1997 |
| JP | 09-096793 | 4/1997 |
| JP | 200-172236 | 6/2000 |
| JP | 2000-258751 | 9/2000 |

OTHER PUBLICATIONS

U.S. Appl. No. 10/306,810, filed Nov. 27, 2002, Yusuke Ota.
U.S. Appl. No. 10/306,781, filed Nov. 27, 2002, Yusuke Ota.

* cited by examiner

*Primary Examiner*—Vijay Shankar
*Assistant Examiner*—Leonid Shapiro
(74) *Attorney, Agent, or Firm*—Hogan & Hartson, LLP

(57) ABSTRACT

In a display data RAM, a group of memory cells for storing grayscale data for two lines are disposed within an output pad pitch L of a display driver circuit, and at least two groups of the memory cells are arranged in a direction perpendicular to the direction in which the output pads are arranged. The grayscale data for two lines is read at a time from the display data RAM. Latch circuits latch the grayscale data for four lines based on first and second clock signals. A selector circuit selectively outputs the grayscale data for consecutive three lines from among the grayscale data latched in the latch circuit. An MLS signal conversion circuit performs MLS operation in which three lines are simultaneously selected, based on the selectively output grayscale data for three lines. A signal electrode driver circuit outputs a drive voltage to the output pads based on the MLS operation results.

13 Claims, 28 Drawing Sheets

(Prior Art) ← ADDED

FIG. 4A FIRST READ OPERATION
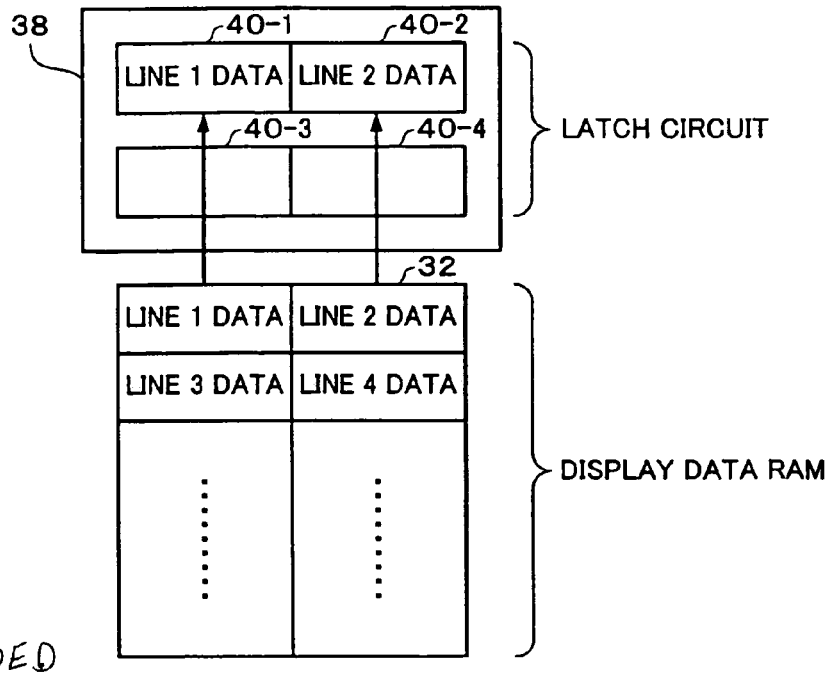
(Prior Art)
ADDED
FIG. 4B SECOND READ OPERATION
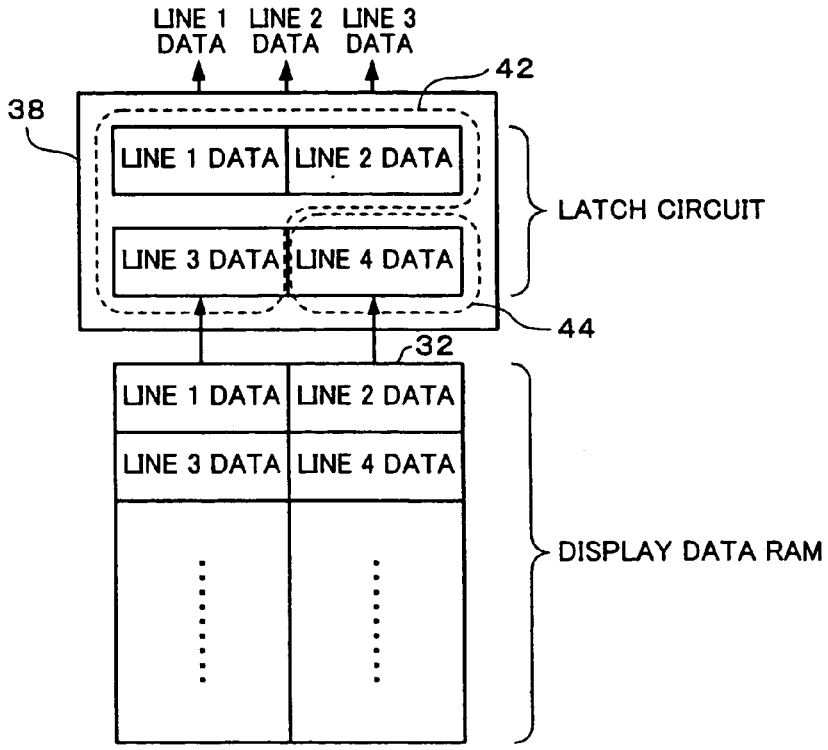
(Prior Art)
ADDED FIG. 6A FIRST READ TIMING
FIG. 6B SECOND READ TIMING (FIRST PERIOD)
FIG. 6C THIRD READ TIMING (SECOND PERIOD)
SELECTOR CIRCUIT
60
58-1
58-2
58-3
58-4
56
50
SELECT CONTROL SIGNAL
FIRST CLOCK SIGNAL
SECOND CLOCK SIGNAL
RMA
RMB
LINE 1 DATA
LINE 2 DATA
LINE 3 DATA
LINE 4 DATA
LINE 5 DATA
LINE 6 DATA

FIG. 9

| INA | INB | INC | IND | DTSEL | OUT1 | OUT2 | OUT3 |
|---|---|---|---|---|---|---|---|
| a | b | c | d | H | d | a | b |
| a | b | c | d | L | a | b | c |

a, b, c, AND d ARE EITHER H OR L

FIG. 14

RELATIONSHIP BETWEEN FIELD AND COM WAVEFORM

| | FIELD 1 | FIELD 2 | FIELD 3 | FIELD 4 |
|---|---|---|---|---|
| F1 | H | H | L | L |
| F2 | H | L | H | L |
| LINE 1 | 1 | 1 | −1 | 1 |
| LINE 2 | −1 | 1 | 1 | 1 |
| LINE 3 | 1 | −1 | 1 | 1 |
| LINE 4 (DUMMY LINE) | 1 | 1 | 1 | −1 |

1 : CORRESPONDING TO VOLTAGE LEVEL V3、−1 : CORRESPONDING TO VOLTAGE LEVEL MV3

FIG. 16A

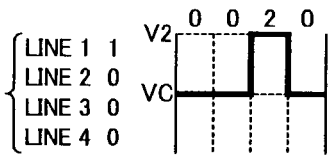

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| | 0 | 0 | 2 | 0 | | | | | |
| LINE 1 1 | | | | | LINE 1 Vy | Vy | −Vy−2Vx | Vy | $Von^2$ |
| LINE 2 0 | | | | | LINE 2 −Vy | Vy | Vy−2Vx | Vy | $Voff^2$ |
| LINE 3 0 | | | | | LINE 3 Vy | −Vy | Vy−2Vx | Vy | $Voff^2$ |
| LINE 4 0 | | | | | LINE 4 Vy | Vy | Vy−2Vx | −Vy | $Voff^2$ |

FIG. 16B

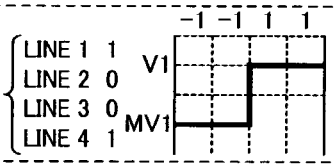

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| | −1 | −1 | 1 | 1 | | | | | |
| LINE 1 1 | | | | | LINE 1 Vy+Vx | Vy+Vx | −Vy−Vx | Vy−Vx | $Von^2$ |
| LINE 2 0 | | | | | LINE 2 −Vy+Vx | Vy+Vx | Vy−Vx | Vy−Vx | $Voff^2$ |
| LINE 3 0 | | | | | LINE 3 Vy+Vx | −Vy+Vx | Vy−Vx | Vy−Vx | $Voff^2$ |
| LINE 4 1 | | | | | LINE 4 Vy+Vx | Vy+Vx | Vy−Vx | −Vy−Vx | $Von^2$ |

FIG. 16C

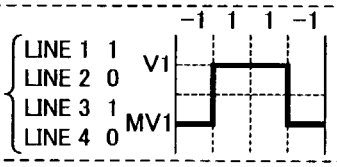

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| | −1 | 1 | 1 | −1 | | | | | |
| LINE 1 1 | | | | | LINE 1 Vy+Vx | Vy−Vx | −Vy−Vx | Vy+Vx | $Von^2$ |
| LINE 2 0 | | | | | LINE 2 −Vy+Vx | Vy−Vx | Vy−Vx | Vy+Vx | $Voff^2$ |
| LINE 3 1 | | | | | LINE 3 Vy+Vx | −Vy−Vx | Vy−Vx | Vy+Vx | $Von^2$ |
| LINE 4 0 | | | | | LINE 4 Vy+Vx | Vy−Vx | Vy−Vx | −Vy+Vx | $Voff^2$ |

FIG. 16D

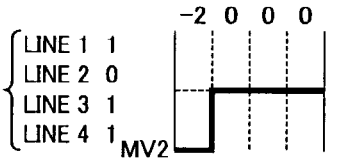

| DISPLAY PATTERN (0=OFF, 1=ON) | SEG WAVEFORM 1f | 2f | 3f | 4f | VOLTAGE APPLIED TO LIQUID CRYSTAL LAYER 1f | 2f | 3f | 4f | EVALUATION VALUE |
|---|---|---|---|---|---|---|---|---|---|
| | −2 | 0 | 0 | 0 | | | | | |
| LINE 1 1 | | | | | LINE 1 Vy+2Vx | Vy | −Vy | Vy | $Von^2$ |
| LINE 2 0 | | | | | LINE 2 −Vy+2Vx | Vy | Vy | Vy | $Voff^2$ |
| LINE 3 1 | | | | | LINE 3 Vy+2Vx | −Vy | Vy | Vy | $Von^2$ |
| LINE 4 1 | | | | | LINE 4 Vy+2Vx | Vy | Vy | −Vy | $Von^2$ |

FIG. 17E

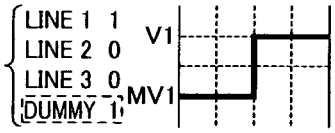

| | VOLTAGE APPLIED TO LIQUID CRYSTAL LAYER 1f | 2f | 3f | 4f | EVALUATION VALUE |
|---|---|---|---|---|---|
| LINE 1 | Vy+Vx | Vy+Vx | −Vy−Vx | Vy−Vx | $Von^2$ |
| LINE 2 | −Vy+Vx | Vy+Vx | Vy−Vx | Vy−Vx | $Voff^2$ |
| LINE 3 | Vy+Vx | −Vy+Vx | Vy−Vx | Vy−Vx | $Voff^2$ |

FIG. 17F

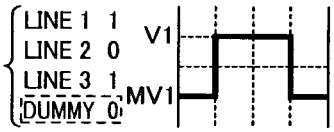

| | VOLTAGE APPLIED TO LIQUID CRYSTAL LAYER 1f | 2f | 3f | 4f | EVALUATION VALUE |
|---|---|---|---|---|---|
| LINE 1 | Vy+Vx | Vy−Vx | −Vy−Vx | Vy+Vx | $Von^2$ |
| LINE 2 | −Vy+Vx | Vy−Vx | Vy−Vx | Vy+Vx | $Voff^2$ |
| LINE 3 | Vy+Vx | −Vy−Vx | Vy−Vx | Vy+Vx | $Von^2$ |

FIG. 17G

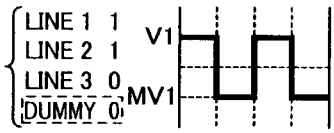

| | VOLTAGE APPLIED TO LIQUID CRYSTAL LAYER 1f | 2f | 3f | 4f | EVALUATION VALUE |
|---|---|---|---|---|---|
| LINE 1 | Vy−Vx | Vy+Vx | −Vy−Vx | Vy+Vx | $Von^2$ |
| LINE 2 | −Vy−Vx | Vy+Vx | Vy−Vx | Vy+Vx | $Von^2$ |
| LINE 3 | Vy−Vx | −Vy+Vx | Vy−Vx | Vy+Vx | $Voff^2$ |

FIG. 17H

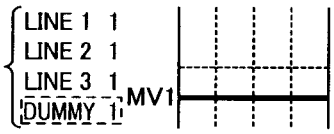

| | VOLTAGE APPLIED TO LIQUID CRYSTAL LAYER 1f | 2f | 3f | 4f | EVALUATION VALUE |
|---|---|---|---|---|---|
| LINE 1 | Vy+Vx | Vy+Vx | −Vy+Vx | Vy+Vx | $Von^2$ |
| LINE 2 | −Vy+Vx | Vy+Vx | Vy+Vx | Vy+Vx | $Von^2$ |
| LINE 3 | Vy+Vx | −Vy+Vx | Vy+Vx | Vy+Vx | $Von^2$ |

FIG. 18

RELATIONSHIP BETWEEN DISPLAY PATTERN AND DUMMY PATTERN, AND MLS OPERATION RESULTS

400

404

| DISPLAY PATTERN (-1 : CORRESPONDING TO ON, 1 : CORRESPONDING TO OFF) | | | | MLS OPERATION RESULTS (2 : CORRESPONDING TO VOLTAGE LEVEL V1, -2 : CORRESPONDING TO VOLTAGE LEVEL MV1) | | | |
|---|---|---|---|---|---|---|---|
| LINE 1 | LINE 2 | LINE 3 | DUMMY PATTERN | FIELD 1 | FIELD 2 | FIELD 3 | FIELD 4 |
| 1 | 1 | 1 | 1 | 2 | 2 | 2 | 2 |
| 1 | 1 | -1 | -1 | -2 | 2 | -2 | 2 |
| 1 | -1 | 1 | -1 | 2 | -2 | -2 | 2 |
| 1 | -1 | -1 | 1 | 2 | 2 | -2 | -2 |
| -1 | 1 | 1 | -1 | -2 | -2 | 2 | 2 |
| -1 | 1 | -1 | 1 | -2 | 2 | 2 | -2 |
| -1 | -1 | 1 | 1 | 2 | -2 | 2 | -2 |
| -1 | -1 | -1 | -1 | -2 | -2 | -2 | -2 |

410

402

412

FIG. 19

DECODE TRUTH TABLE OF 3 MLS OPERATION RESULTS

| | D1 | D2 | D3 | OUT (H: VOLTAGE LEVEL V1, L: VOLTAGE LEVEL MV1) |
|---|---|---|---|---|
| FIELD 1 (f1=「H」) | 0 | 0 | 0 | H |
| | 0 | 0 | 1 | L |
| | 0 | 1 | 0 | H |
| | 0 | 1 | 1 | H |
| | 1 | 0 | 0 | L |
| | 1 | 0 | 1 | L |
| | 1 | 1 | 0 | H |
| | 1 | 1 | 1 | L |
| FIELD 2 (f2=「H」) | 0 | 0 | 0 | H |
| | 0 | 0 | 1 | H |
| | 0 | 1 | 0 | L |
| | 0 | 1 | 1 | H |
| | 1 | 0 | 0 | L |
| | 1 | 0 | 1 | H |
| | 1 | 1 | 0 | L |
| | 1 | 1 | 1 | L |
| FIELD 3 (f3=「H」) | 0 | 0 | 0 | H |
| | 0 | 0 | 1 | L |
| | 0 | 1 | 0 | L |
| | 0 | 1 | 1 | L |
| | 1 | 0 | 0 | H |
| | 1 | 0 | 1 | H |
| | 1 | 1 | 0 | H |
| | 1 | 1 | 1 | L |
| FIELD 4 (f4=「H」) | 0 | 0 | 0 | H |
| | 0 | 0 | 1 | H |
| | 0 | 1 | 0 | H |
| | 0 | 1 | 1 | L |
| | 1 | 0 | 0 | H |
| | 1 | 0 | 1 | L |
| | 1 | 1 | 0 | L |
| | 1 | 1 | 1 | L |

1: CORRESPONDING TO ON, 0: CORRESPONDING TO OFF

DISPLAY PATTERN

| | D4 | D3 | D2 | D1 |
|---|---|---|---|---|
| LINE 1 | 0 | 0 | 0 | 0 |
| LINE 2 | 0 | 0 | 0 | 1 |
| LINE 3 | 0 | 0 | 1 | 0 |
| DUMMY | 0 | 0 | 1 | 1 |

SEG WAVEFORM

DISPLAY PATTERN

| | D4 | D3 | D2 | D1 |
|---|---|---|---|---|
| LINE 1 | 0 | 0 | 1 | 1 |
| LINE 2 | 0 | 1 | 0 | 0 |
| LINE 3 | 0 | 1 | 0 | 1 |
| DUMMY | 0 | 0 | 1 | 0 |

SEG WAVEFORM

DISPLAY PATTERN

| | D4 | D3 | D2 | D1 |
|---|---|---|---|---|
| LINE 1 | 0 | 1 | 1 | 0 |
| LINE 2 | 0 | 1 | 1 | 1 |
| LINE 3 | 1 | 0 | 0 | 0 |
| DUMMY | 1 | 0 | 0 | 1 |

SEG WAVEFORM

DISPLAY DRIVER CIRCUIT, ELECTRO-OPTICAL DEVICE, AND DISPLAY DRIVE METHOD

Japanese Patent Application No. 2001-371472, filed on Dec. 5, 2001, is hereby incorporated by reference in its entirety.

BACKGROUND OF THE INVENTION

The present invention relates to a display driver circuit, an electro-optical device, and a display drive method.

In a simple matrix liquid crystal panel, the response time is improved by multi-line selection (MLS) in which a plurality of scan electrodes are simultaneously selected, whereby an increase in contrast and a decrease in power consumption are realized.

MLS operations are performed by using a scan pattern of a plurality of simultaneously selected scan electrodes and grayscale data for a plurality of lines corresponding to the scan pattern. The results for the MLS operations are supplied to the signal electrodes over a plurality of fields. This allows the response time of the simple matrix liquid crystal panel to be improved and power consumption to be decreased. Therefore, it is necessary to perform operations by using the grayscale data for a plurality of lines per signal electrode.

BRIEF SUMMARY OF THE INVENTION

According to one aspect of the present invention, there is provided a display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit.

According to another aspect of the present invention, there is provided a display driver circuit which drives a plurality of signal electrodes in a display panel which also has a plurality of scan electrodes intersecting the signal electrodes by multi-line selection in which m lines (m is an integer equal to two or more) are simultaneously selected, the display driver circuit comprising:

a RAM which stores display data for driving the display panel, the display data for n lines (n is a natural number) being read out at a time from the RAM, n being less than m;

first to q-th latch circuits (q is a natural number, $2n \leqq q$, and $m<q$) which retain the display data for q lines read from the RAM;

a selector circuit which selects the display data for consecutive m lines from among the display data retained in the first to q-th latch circuits and outputs the selected display data, based on a given select control signal; and a signal electrode driver circuit which drives the signal electrode by using given operation results based on the display data for m lines selectively output from the selector circuit.

BRIEF DESCRIPTION OF THE SEVERAL VIEWS OF THE DRAWING

FIGS. 4A and 4B are diagrams for describing read operations in the case of performing 3MLS in the signal driver in the comparative example.

FIG. 9 is a truth table showing the operation of a four-input, three-output select circuit of the selector circuit.

FIG. 14 is a table illustrative of the relationship between fields and common waveforms.

FIGS. 16A to 16H are diagrams illustrative of the segment waveforms, voltages applied to a liquid crystal layer, and evaluation values in the case of 4MLS.

FIGS. 17A to 17H are diagrams illustrative of the segment waveforms, voltages applied to a liquid crystal layer, and evaluation values in the case of 3MLS according to the present invention.

FIG. 18 is a table illustrative of the relationship between a display pattern and MLS operation results according to the present invention.

FIG. 19 is an example of truth table showing the MLS decoder according to the present invention.

DETAILED DESCRIPTION OF THE EMBODIMENTS

Figure 1:
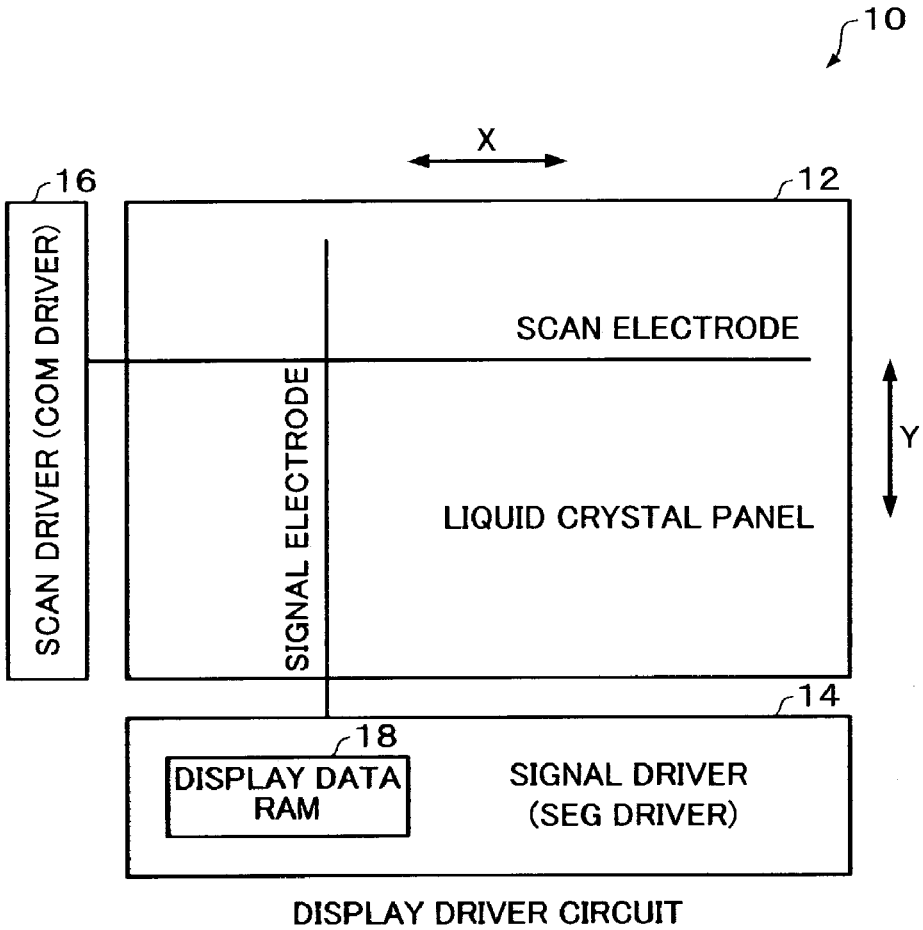
FIG. 1 is a block diagram showing an example of a configuration of an electro-optical device according to the present invention.

Embodiments of the present invention are described below.

Note that the embodiments described below do not in any way limit the scope of the invention defined by the claims laid out herein. Similarly, all the elements of the embodiments described below should not be taken as essential requirements of the present invention.

A signal driver which drives a signal electrode generally includes a RAM which stores grayscale data. As a result, a decrease in power consumption is achieved by decreasing access from the outside. Each memory cell which makes up the RAM is formed in units of the signal electrodes. A drive voltage corresponding to the grayscale data read from each memory cell in line units is supplied to output pads. The output pads are arranged in a direction in which the signal electrodes are arranged. Therefore, the memory cells which store the grayscale data for each line are disposed in the signal driver so that the width of the memory cells are less than the pitch between the output pads.

An increase in display quality of a liquid crystal panel has been strongly demanded. Therefore, the pitch between the signal electrodes tends to be decreased in order to make pixels high definite, and the number of bits of grayscale data tends to be increased in order to increase the number of grayscales. As a result, memory cells for only a limited number of lines can be disposed to have a width smaller than the output pad pitch. In the case where grayscale data for a plurality of lines is necessary such as in MLS, the grayscale data is read from the display data RAM over two or more times. Therefore, in the case of performing MLS in which four lines are simultaneously selected (4MLS) by allowing the grayscale data to be read in two line units, MLS operations are performed for each two read operations. In the case of performing MLS in which three lines are simultaneously selected (3MLS) by allowing the grayscale data to be read in two line units, MLS operations are also performed for each two read operations. However, the grayscale data for one line is allowed to remain in 3MLS. If the remaining grayscale data for one line is read by the next read operation, unnecessary electric power is consumed.

As described above, power consumption may be increased by unnecessary read operations in the case where the grayscale data for the number of simultaneously selected lines in MLS must be read from the display data RAM over two or more times.

According to the embodiments described below, a display driver circuit which drives display by efficiently reading grayscale data when performing two or more times of read operations, an electro-optical device, and a display drive method can be provided.

According to one embodiment of the present invention, there is provided a display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit.

The RAM from which the display data is read in two line units maybe formed so that the display data is read by activating one word line shared between memory cells which store the display data for two lines, for example.

A display driver circuit which drives the signal electrode by using 3MLS generates MLS operation results by using a scan pattern of the simultaneously selected three scan electrodes and display data for three lines corresponding to the scan pattern, and drives the signal electrode based on the MLS operation results. In this embodiment, the display data read from the RAM in two line units is retained in the first to fourth latch circuits. The selector circuit selectively outputs the display data for consecutive three lines from among the display data retained in the first to fourth latch circuits based on the given select control signal.

This enables the display data for consecutive three lines to be selectively output without reading the display data once retained in the latch circuits from the RAM. Therefore, the signal electrode can be driven by using the display data for three lines necessary for generating the MLS operation results while preventing an increase in power consumption accompanied by unnecessary read operations from the RAM.

In this display driver circuit, the first and second latch circuits may retain the display data for first and second lines in a first period, and retain the display data for fifth and sixth lines in a second period;

the third and fourth latch circuits may retain the display data for third and fourth lines in the first period, and continuously retain the display data for the third and fourth lines in the second period;

the selector circuit may selectively output the display data for the first to third lines from among the display data for the first to fourth lines retained in the first to fourth latch circuits based on the select control signal in the first period; and the selector circuit may selectively output the display data for the fourth to sixth lines from the display data for the third to sixth lines retained in the first to fourth latch circuits based on the select control signal in the second period.

In this embodiment, the display data for the fourth line retained in the first period is continuously retained in the second period, and the selector circuit selectively outputs the display data for the fourth line together with the display data for the fifth and sixth lines retained in the second period. Therefore, the display data for consecutive first to third lines is selectively output from among the display data for the first to fourth lines retained in the first period, and the display data for the succeeding fourth to sixth lines is selectively output in the second period. This enables the MLS operation results necessary for 3MLS drive to be generated by using the efficiently read display data.

In this display driver circuit, the first and second latch circuits may retain the display data for first and second lines which is collectively read from the RAM on the falling edge of a first clock signal; and the third and fourth latch circuits may retain the display data for third and fourth lines which is collectively read from the RAM after the reading of the display data for the first and second lines, on the falling edge of a second clock signal obtained by dividing the first clock signal from the rising edge of the first clock signal.

According to this embodiment, since the display data is latched by using the first clock signal and the second clock signal obtained by dividing the first clock signal, latch control can be performed by using an extremely simple configuration. In particular, latch timing of the first to fourth latch circuits can be specified by using the second clock signal obtained by dividing the frequency of the first clock signal by ½ from the rising edge of the first clock signal, without causing the falling edges of the first and second clock signals to overlap. Since the latch control in which the display data is retained in two line units is simplified by the first and second latch circuits and the third and fourth latch circuits, selective output control of the display data for the consecutive three lines is also simplified.

In this display driver circuit, when the number of grayscale bits of the display data is p (p is a natural number), the RAM may have a group of memory cells for 2p-bit data which are disposed in the direction in which output pads connected to the signal electrodes are arranged, the width of a group of the memory cells being less than a pitch between the output pads; and at least two groups of the memory cells may be arranged in a direction perpendicular to the direction in which the output pads are arranged.

According to this embodiment, the RAM which may include a group of the memory cells for 2p bits having a width shorter than the output pad pitch, arranged in the direction in which the output pads are arranged, is employed, and at least two groups of the memory cells of the RAM may extends in a direction perpendicular to the direction in which the output pads are arranged. Therefore, the display driver circuit can be applied to a case of performing grayscale display of a plurality of bits.

In this display driver circuit, each of the memory cells may have a width d in the direction in which the output pads are arranged, and the pitch between the output pads may have a length L; and the width of a group of the memory cells for two lines may be less than the output pad pitch when the pitch has the length L ranging from 8d to 12d.

According to this embodiment, since a group of the memory cells for two lines have a width smaller than the output pad pitch and the memory cells in each line has four-bit data, the display driver circuit can be applied to 4-bit grayscale (16 grayscales) display.

According to another embodiment of the present invention, there is provided a display driver circuit which drives a plurality of signal electrodes in a display panel which also has a plurality of scan electrodes intersecting the signal electrodes by multi-line selection in which m lines (m is an integer equal to two or more) are simultaneously selected, the display driver circuit comprising:

a RAM which stores display data for driving the display panel, the display data for n lines (n is a natural number) being read out at a time from the RAM, n being less than m;

first to q-th latch circuits (q is a natural number, $2n \leqq q$, and $m<q$) which retain the display data for q lines read from the RAM;

a selector circuit which selects the display data for consecutive m lines from among the display data retained in the first to q-th latch circuits and outputs the selected display data, based on a given select control signal; and a signal electrode driver circuit which drives the signal electrode by using given operation results based on the display data for m lines selectively output from the selector circuit.

A display driver circuit, which drives the signal electrode by using m-line MLS, generates MLS operation results by using a scan pattern of simultaneously selected m lines of scan electrodes and display data for m lines corresponding to the scan pattern, and drives the signal electrode based on the MLS operation results. In this embodiment, the display data read from the RAM in n line units is retained in the first to q-th latch circuits. Specifically, the grayscale data for q lines is retained by two or more times of read operations. The selector circuit selectively outputs the display data for the consecutive m lines from among the display data retained in the first to q-th latch circuits based on the given select control signal.

This enables the display data for the consecutive m lines to be selectively output without reading the display data once retained in the latch circuits from the RAM. Therefore, the signal electrode can be driven by using the display data for the m lines necessary for generating the MLS operation results while preventing an increase in power consumption accompanied by unnecessary read operations from the RAM.

The display driver circuit according to this embodiment may further comprise a circuit which generates a signal having a pulse width modulated based on the operation results, wherein the signal electrode driver circuit drives the signal electrodes based on the signal having a modulated pulse width.

According to this embodiment, a display driver circuit capable of decreasing power consumption by omitting redundant read operations and enabling various grayscale display by pulse width modulation can be provided.

According to still another embodiment of the present invention, there is provided a display drive method which drives a plurality of signal electrodes in a display panel which also has a plurality of scan electrodes intersecting the signal electrodes by multi-line selection in which three lines are simultaneously selected, the display drive method comprising:

reading out display data for two lines from a RAM which stores the display data used for driving the display panel;

retaining the display data read from the RAM;

selecting the display data for consecutive first to third lines from among the retained display data for the first to fourth lines and then outputting the selected display data, based on a given select control signal in a first period;

retaining display data for fifth and sixth lines following the fourth line, before selecting the display data for the fourth to sixth lines and outputting the selected display data, based on the select control signal in a second period following the first period; and driving the signal electrode by using given operation results based on the selectively output display data for consecutive three lines.

In the case of driving the signal electrode by using 3MLS, MLS operation results are generated by using a scan pattern of simultaneously selected three scan electrodes and display data for three lines corresponding to the scan pattern, and the signal electrode is driven based on the MLS operation results. In this embodiment, the display data read from the RAM in two line units is retained, and the display data for consecutive three lines is selectively output from among the retained display data for four lines. This enables the display data for the consecutive three lines to be selectively output without reading the display data once retained from the RAM. Therefore, the signal electrode can be driven by using the display data for three lines necessary for generating the MLS operation results while preventing an increase in power consumption accompanied by unnecessary read operations from the RAM.

According to yet another embodiment of the present invention, there is provided a display drive method which drives a plurality of signal electrodes in a display panel which also has a plurality of scan electrodes intersecting the signal electrodes multi-line drive selection in which m lines (m is an integer equal to two or more) are simultaneously selected, the display drive method comprising:

reading out display data for n lines (n is a natural number less than m) from a RAM which stores the display data used for driving the display panel;

retaining the display data read from the RAM;

selecting the display data for consecutive m lines from among the retained display data for q lines (q is a natural number, and $2n \leqq q$, and $m<q$) and outputting the selected display data, based on a given select control signal; and driving the signal electrodes by using given operation results based on the selectively output display data for m lines.

In the case of driving the signal electrode by using m-line MLS, MLS operation results are generated by using a scan pattern of simultaneously selected m scan electrodes and a display pattern for m lines corresponding to the scan pattern, and the signal electrode is driven based on the MLS operation results. In this embodiment, the display data read from the RAM in n line units is retained. Specifically, grayscale data for q lines is retained by two or more times of read operations. The display data for the consecutive m lines is selectively output from among the retained display data for q lines. Since the display data for the consecutive m lines is selectively output without reading the retained display data from the RAM, the signal electrode can be driven by using the display data for m lines necessary for generating the MLS operation results while preventing an increase in power consumption accompanied by unnecessary read operation from the RAM.

According to further embodiment of the present invention, there is provided an electro-optical device which is driven by multi-line selection in which a plurality of scan electrodes are simultaneously selected, the electro-optical device comprising:

a pixel specified by one of the scan electrodes and one of a plurality of signal electrodes intersecting the scan electrodes;

one of the above described display driver circuit which drives the signal electrodes; and a scan driver which drives the scan electrodes.

According to this embodiment, an electro-optical device capable of decreasing power consumption of the entire device by using a display driver circuit which decreases power consumption by optimizing the read operations of the display data from the RAM can be provided.

According to still further embodiment of the present invention, there is provided an electro-optical device which is driven by multi-line selection in which a plurality of scan electrodes are simultaneously selected, the electro-optical device comprising:

a display panel having a pixel specified by one of the scan electrodes and one of a plurality of signal electrodes intersecting the scan electrodes;

the display driver circuit as defined in claim 1 which drives the signal electrodes; and a scan driver which drives the scan electrodes.

According to this embodiment, an electro-optical device capable of decreasing power consumption of the entire device by using a display driver circuit which decreases power consumption by optimizing the read operations of the display data from the RAM can be provided.

These embodiments of the present invention are described below in detail with reference to the drawings.

1. Electro-Optical Device

FIG. 1 shows an example of a configuration of an electro-optical device according to these embodiments of the present invention.

A liquid crystal device (electro-optical device or display device in a broad sense) 10 includes a liquid crystal panel (display panel in a broad sense) 12.

The liquid crystal device 10 may include a signal driver (segment driver, display driver circuit in a broad sense) 14 which drives the liquid crystal panel 12. The liquid crystal device 10 may include a scan driver (common driver) 16 which drives the liquid crystal panel 12.

Pixels having liquid crystal elements (electro-optical elements in a broad sense) held in intersection regions between signal electrodes and scan electrodes are provided to the liquid crystal panel 12. Each pixel is specified by one of the signal electrodes and one of the scan electrodes. There are no specific limitations to the liquid crystal panel 12 insofar as the liquid crystal panel 12 utilizes electro-optical elements such as a liquid crystal of which the optical characteristics are changed by application of voltage. In this case, the liquid crystal panel 12 has a configuration described below. Specifically, a liquid crystal is sealed between a first substrate on which a plurality of signal (segment) electrodes (first electrodes) are formed and a second substrate on which a plurality of scan (common) electrodes (second electrodes) are formed. A plurality of the signal electrodes are arranged on the first substrate in a direction X. A plurality of the scan electrodes are arranged on the second substrate in a direction Y. A plurality of the signal electrodes are driven by the signal driver 14. A plurality of the scan electrodes are driven by the scan driver 16.

The liquid crystal panel 12 may be mounted on a glass substrate, and the signal driver 14 or the scan driver 16, or both, may be provided on the glass substrate.

The signal driver 14 includes a display data RAM (RAM in a broad sense) 18. The display data RAM 18 stores one or more bits of grayscale data (display data in a broad sense) for each signal electrode in order to drive each signal electrode.

A drive voltage of the signal electrode driven by the signal driver 14 is generated by a power supply circuit (not shown). The power supply circuit generates voltage supplied to the scan driver 16. The scan driver 16 drives the scan electrodes by using the voltage supplied from the power supply circuit. The power supply circuit may be provided in either the signal driver 14 or the scan driver 16.

The liquid crystal panel 12 is driven by using a multi-line drive method (multi-line selection: MLS) in which a plurality of the scan electrodes are simultaneously selected. In the case where the number of simultaneously selected scan electrodes is m (m is a natural number; m=4, for example) , the scan driver 16 scans the scan electrodes in units of m lines. The signal driver outputs voltage having a segment waveform (signal electrode drive waveform, SEG waveform) based on a display pattern in units of n lines (n is a natural number; n=4 when m=4, for example) to the signal electrode. The segment waveform is specified by MLS operation results for the display patterns by using orthogonal functions corresponding to the scan pattern of the scan electrodes.

In the case of MLS in which m lines are simultaneously selected (m-line MLS), the number of voltage levels necessary for driving the scan electrodes is three, and the number of voltage levels necessary for driving the signal electrode is (m+1). In this case, three values of voltage levels necessary for driving the scan electrodes and (m+1) values of voltage levels necessary for driving the signal electrode are generated by the power supply circuit, and respectively supplied to the scan driver and the signal driver. In these embodiments, in order to decrease the number of voltage levels in the signal driver as much as possible, MLS in which three lines are simultaneously selected (3MLS) is driven by using two values of voltage levels and contrast equal to MLS in which four lines are simultaneously selected (4MLS) is realized by using a concept of a virtual electrode. In more detail, the signal driver in these embodiments outputs operation results for three lines obtained by the same operations as in 4MLS on the display pattern for three lines corresponding to the scan electrodes and a dummy display pattern (dummy pattern) corresponding to the display pattern by using the scan pattern of the simultaneously selected three scan electrodes and a dummy scan pattern of the virtual electrode corresponding to the scan pattern of the scan electrodes.

The signal driver as a display driver circuit which drives the signal electrode by using MLS is described below.

2. Signal Driver (Display Driver Circuit)

2.1 Signal Driver in Comparative Example

A signal driver in a comparative example is described below in order to describe the features of the signal driver in these embodiments.

Figure 2:
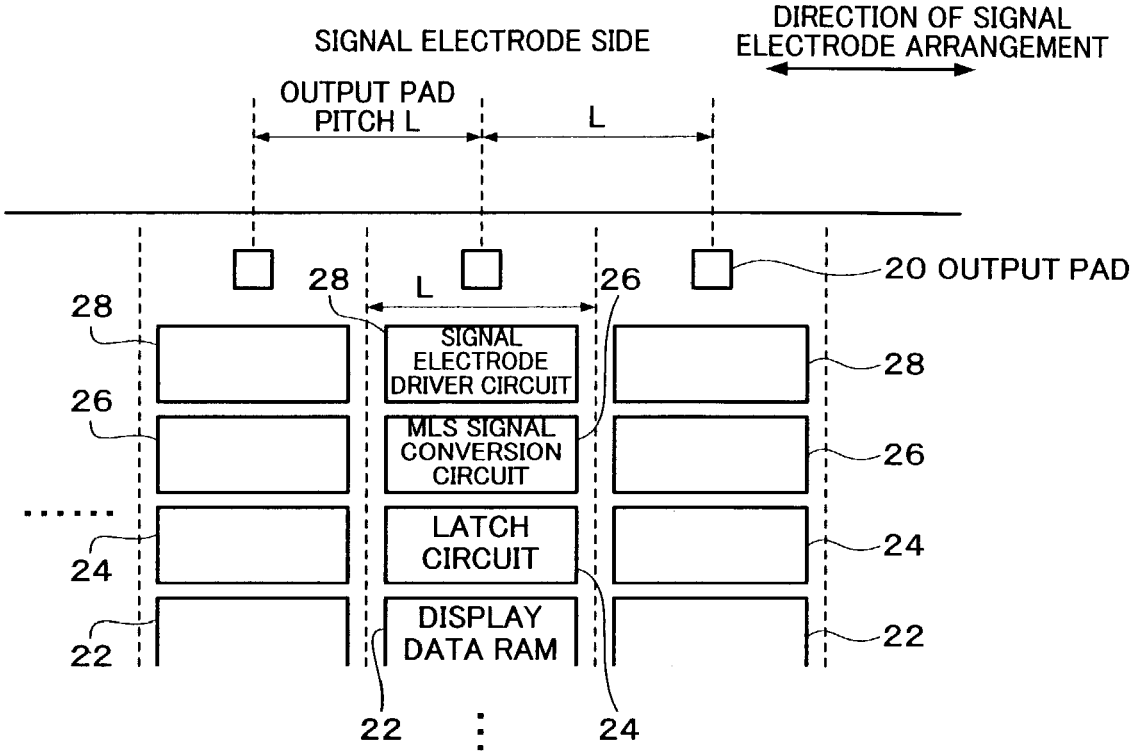
FIG. 2 is a diagram schematically showing part of a layout arrangement of a signal driver which drives display by MLS.

FIG. 2 schematically shows part of a layout arrangement of a signal driver which drives display by MLS.

In the signal driver, output pads 20 for connecting the signal driver with each signal electrode are disposed in a direction in which the signal electrodes are arranged. An output pad pitch L is provided between the output pads. The signal driver includes a display data RAM 22, a latch circuit 24, an MLS signal conversion circuit 26, and a signal electrode driver circuit 28 for each signal electrode (in segment units). The signal driver generates a drive voltage corresponding to the grayscale data for each signal electrode and supplies the drive voltage to the corresponding output pad. Therefore, the display data RAM 22, the latch circuit 24, the MLS signal conversion circuit 26, and the signal electrode driver circuit 28 are disposed within the output pad pitch L.

The grayscale data read from the display data RAM 22 is latched by the latch circuit 24. The latched grayscale data is converted into MLS operation results in the MLS signal conversion circuit 26. The signal electrode driver circuit 28 supplies voltage to the corresponding output pad 20 based on the MLS operation results.

Since the signal driver which drives the signal electrode by using MLS utilizes the MLS operation results, it is necessary to read the grayscale data for a plurality of lines.

Figure 3:
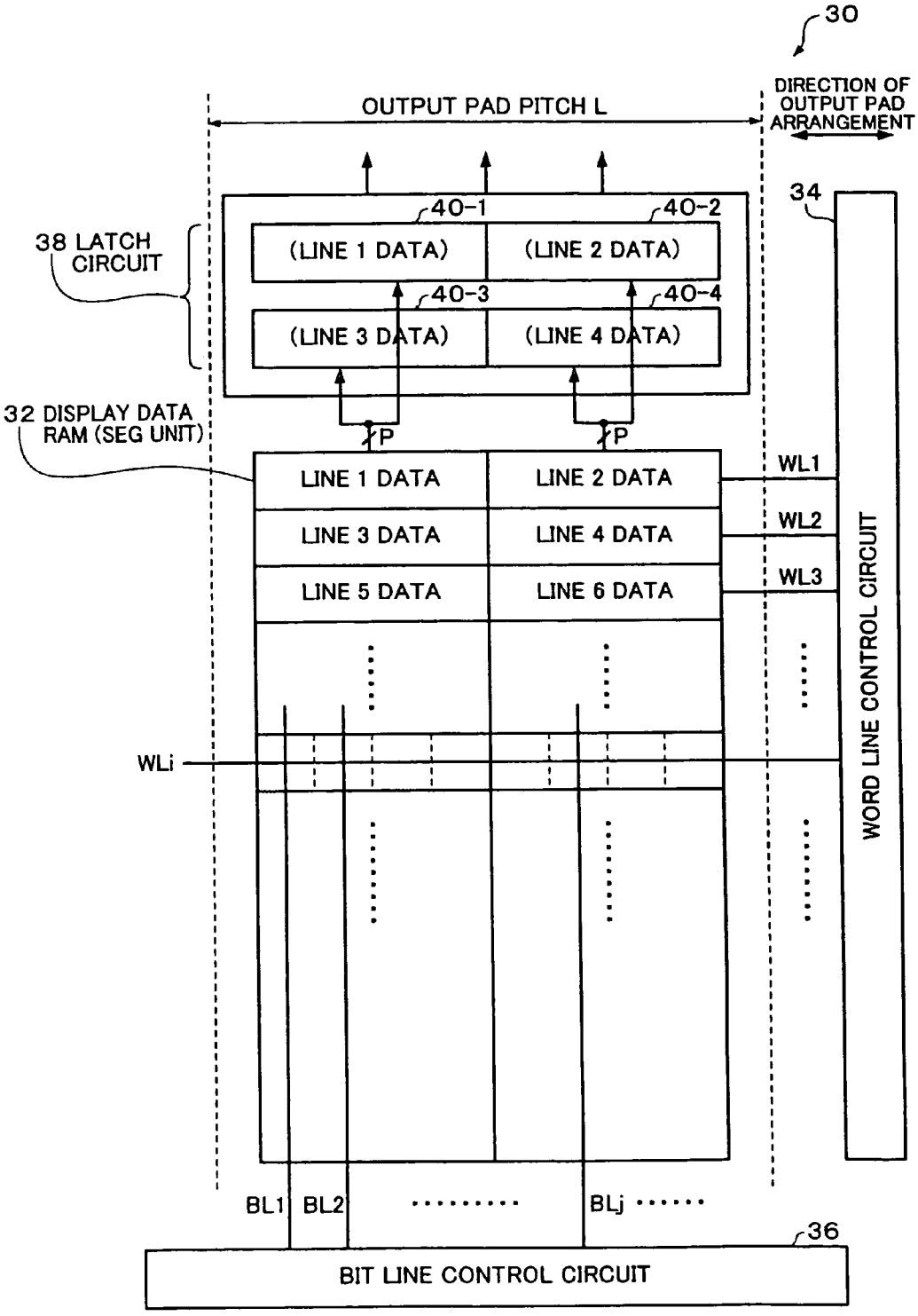
FIG. 3 is a block diagram showing an example of main components of a signal driver as a comparative example.

FIG. 3 shows an example of main components of the signal driver as the comparative example.

A signal driver 30 in the comparative example drives display by using 3MLS. The signal driver 30 includes a display data RAM 32 in segment units. In the display data RAM 32, a group of memory cells storing the grayscale data for two lines can be disposed in a direction in which the output pads are arranged. If the grayscale data is p bits (p is a natural number), for example, a group of 2p memory cells are disposed within a width equal to the output pad pitch L, in the direction in which the output pads are arranged. At least two groups of such 2p memory cells can be arranged in a direction perpendicular to the direction in which the output pads are arranged.

The contents stored in the memory cells specified by a word line WL are read through bit lines BL.

Line (**2*i*-1) data and line (2i) data for two lines are specified by the word line WLi (i is a natural number). Each bit of the data in each line is specified by the bit line BLj ($1 \leqq j \leqq 2p$, j is a natural number). Specifically, the word line WLi is shared between each memory cell in the line (2*i*-1) data and the line (2*i*) data. The word line WLi is also shared between each memory cell in the line (2*i*-1) data and the line (2*i*) data corresponding to other signal electrodes. The bit line BLj is shared between each memory cell in each line in bit units. The word line WLi is controlled by a word line control circuit 34. The word line control circuit 34 controls the word lines for the memory cells in the entire display data RAM provided for each signal electrode. The bit line BLj is controlled by a bit line control circuit 36. The bit line control circuit 36** controls the bit lines for the memory cells in the entire display data RAM provided for each signal electrode.

The data is read from the memory cells through each bit line by precharging each bit line by the bit line control circuit 36 and activating one of the word lines WL1, WL2, . . . by the word line control circuit 34, for example. This allows the grayscale data for two lines (2p bits) to be read by one read operation.

The latch circuit 38 includes first to fourth latch circuits 40-1 to 40-4 which retain the grayscale data for four lines. The 4MLS operation results are generated by using the grayscale data for consecutive three lines selected from among the grayscale data retained in the first to fourth latch circuits 40-1 to 40-4 and a dummy display pattern corresponding to the grayscale data.

The line data (grayscale data) for odd-numbered lines read from the display data RAM 32 is retained in the first latch circuit 40-1 or the third latch circuit 40-3. The line data (grayscale data) for even-numbered lines read from the display data RAM 32 is retained in the second latch circuit 40-2 or the fourth latch circuit 40-4.

FIGS. 4A and 4B are diagrams for describing the read operation in the signal driver shown in FIG. 3 in the case of performing 3MLS.

As shown in FIG. 4A, the line 1 data and the line 2 data are read from the display data RAM 32 by the first read operation, and respectively retained in the first latch circuit 40-1 and the second latch circuit 40-2. As shown in FIG. 4B, the line 3 data and the line 4 data are read from the display data RAM 32 by the second read operation, and respectively retained in the third latch circuit 40-3 and the fourth latch circuit 40-4.

Data 42 for consecutive three lines (the line 1 data to the line 3 data retained in the first to third latch circuits 40-1 to 40-3) is output and used to generate the 4MLS operation results in an MLS signal conversion circuit (not shown).

However, the line 4 data 44 retained in the fourth latch circuit 40-4 cannot be used to generate the MLS operation results if the data subsequent to the line 4 data is not present. In the configuration shown in FIG. 3, the line 3 data and the line 4 data are read by the same operation as the first read operation, and respectively retained in the first latch circuit 40-1 and the second latch circuit 40-2. The line 5 data and the line 6 data are then read by the second read operation and respectively retained in the third latch circuit 40-3 and the fourth latch circuit 40-4. In this case, an excess read operation is necessary since the line 4 data is read twice. Moreover, power consumption is increased accompanied by unnecessary read operations.

In the case where the memory cells for 3p bits which store the display data for three lines are disposed within the output pad pitch L, the grayscale data for three lines necessary for generating the MLS operation results can be provided by one read operation. However, the above problem occurs in the case where the memory cells for 3p bits cannot be disposed within the output pad pitch L due to the manufacturing process of the signal driver or the pitch between the signal electrodes of a liquid crystal panel, or in the case where a plurality of read operations are necessary depending on the number of simultaneously selected lines.

In order to solve the above-described problem, the signal driver in these embodiments has a configuration as described below.

2.2 Signal Driver (Display Driver Circuit)

Figure 5:
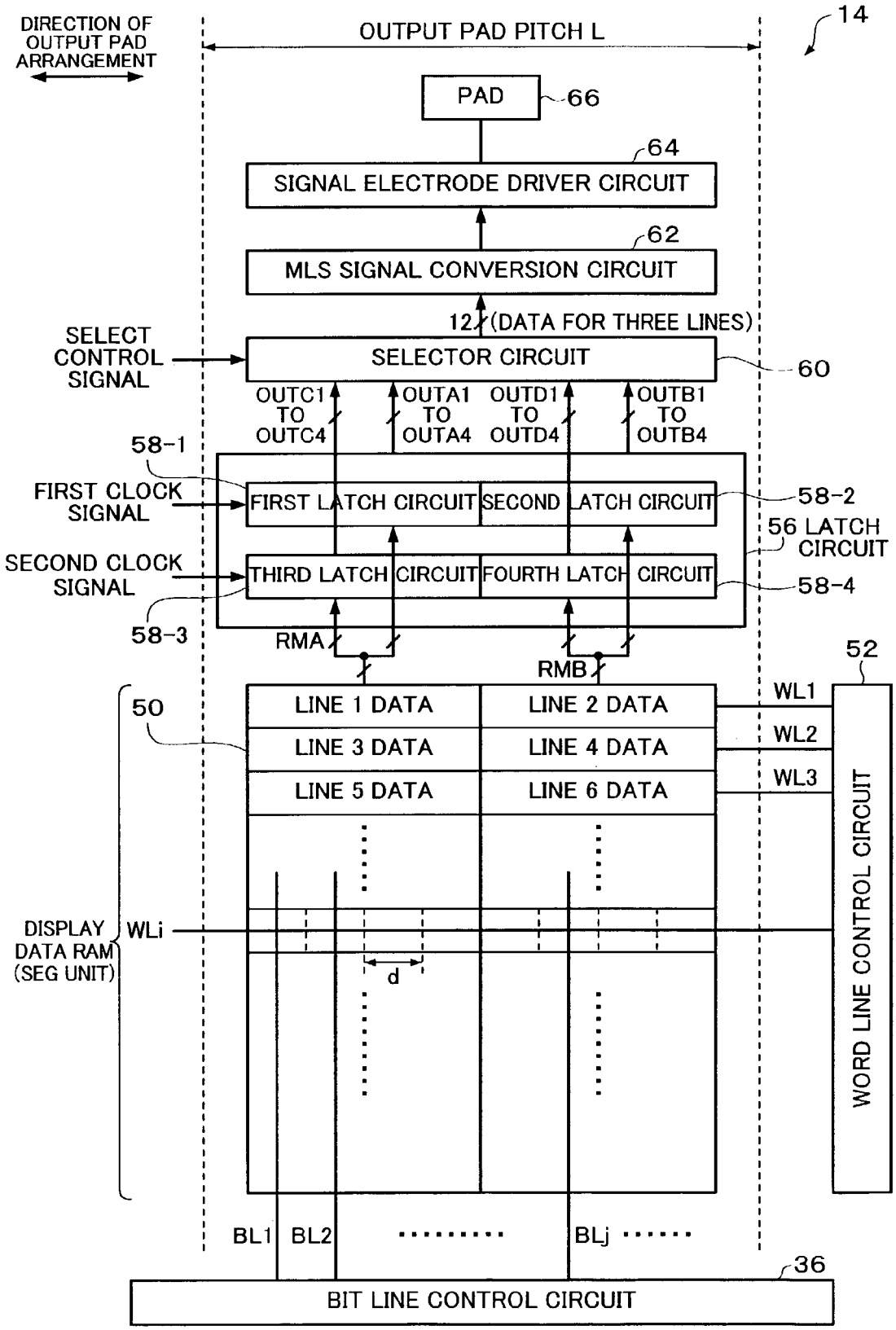
FIG. 5 is a block diagram showing an example of main components of a signal driver according to the present invention.

FIG. 5 shows an example of main components of the signal driver according to the present invention.

The following description is given on the assumption that the number of bits p of the grayscale data is four. However, the present invention is not limited thereto.

The signal driver 14 in these embodiments includes a display data RAM (RAM in a broad sense) 50 which stores the grayscale data, a latch circuit 56, a selector circuit 60, an MLS signal conversion circuit 62, a signal electrode driver circuit 64, and an output pad 66 for each signal electrode. Each section is disposed within the output pad pitch L.

The signal driver 14 drives display by using 3MLS. The signal driver 14 has the display data RAM 50 in segment units. In the display data RAM 50, a group of memory cells storing the grayscale data for two lines are disposed in the direction in which the output pads are arranged. At least two groups of the memory cells for two lines are arranged in a direction perpendicular to the direction in which the output pads are arranged. If the grayscale data is four (p=4) bits, for example, a group of eight memory cells are disposed within a width equal to the output pad pitch L in the direction in which the output pads are arranged. At least two groups of these eight memory cells are arranged in a direction perpendicular to the direction in which the output pads are arranged.

If the width of each of memory cells in the direction in which the output pads are arranged is d, 4-bit grayscale (16 grayscales) display can be achieved in the case where the output pad pitch L has a width ranging from 8d to 12d to dispose the memory cells storing grayscale data for two lines.

Since the configuration of the memory cells is known in the art, description of the configuration of the memory cells is omitted. The contents stored in the memory cells specified by the word line WL are read through the bit lines BL.

The line (2*i*-1) data and the line (2*i*) data for two lines are specified by the word line WLi. Each bit of the data in each line is specified by the bit line BLj ($1 \leqq j \leqq 8$ (=2p)) Specifically, the word line WLi is shared between each memory cell of the line (2*i*-1) data and the line (2*i*) data. The word line WLi is also shared between each memory cell of the line (2*i*-1) data and the line (2*i*) data corresponding to each signal electrode. The bit line BLj is shared between each memory cell of each line in bit units. The word line WLi is controlled by a word line control circuit 52. The word line control circuit 52 controls the word lines for the memory cells in the entire display data RAM provided for each signal electrode. The bit line BLj is controlled by a bit line control circuit 54. The bit line control circuit 54 controls the bit lines for the memory cells in the entire display data RAM provided for each signal electrode.

Data RMA can be read from the memory cells in the odd-numbered line and data RMB can be read from the memory cells in the even-numbered line through the bit lines BL1 to BL8 by precharging the bit lines BL1 to BL8 by the bit line control circuit 54 and activating one of the word lines WL1, WL2, . . . by the word line control circuit 52, for example. This allows the grayscale data for two lines (8 bits) to be read by one read operation.

The latch circuit 56 includes first to fourth latch circuits (retaining circuits) 58-1 to 58-4 which retain the grayscale data for four lines.

The line data (grayscale data) for odd-numbered lines read from the display data RAM 50 is retained in the first latch circuit 58-1 or the third latch circuit 58-3. The line data (grayscale data) for even-numbered lines read from the display data RAM 50 is retained in the second latch circuit 58-2 or the fourth latch circuit 58-4.

The first latch circuit 58-1 retains the data RMA for the odd-numbered line based on a first clock signal. The second latch circuit 58-2 retains the data RMB for the even-numbered line based on a second clock signal. The third latch circuit 58-3 retains the data RMA for the odd-numbered line based on the first clock signal. The fourth latch circuit 58-4 retains the data RMB for the even-numbered line based on the second clock signal.

The grayscale data for four lines retained in the first to fourth latch circuits 58-1 to 58-4 is selectively output as the grayscale data (12 bits) for consecutive three lines by the selector circuit 60 based on a select control signal.

The grayscale data for three lines selectively output by the selector circuit 60 is converted into the 4MLS operation results by the MLS signal conversion circuit 62. The MLS signal conversion circuit 62 may determine the MLS operation results by 4MLS operations. However, the signal driver 14 in these embodiments is provided with ROMs (decoder circuits in a broad sense) as MLS decoders in bit units, and allows the ROMs to decode and output the MLS operation results in order to simplify the configuration. If four bits of grayscale data (OUTA1, OUTA2, OUTA3, and OUTA4) are output from the first latch circuit 58-1, four bits of grayscale data (OUTB1, OUTB2, OUTB3, and OUTB4) are output from the second latch circuit 58-2, four bits of grayscale data (OUTC1, OUTC2, OUTC3, and OUTC4) are output from the third latch circuit 58-3, and four bits of grayscale data (OUTD1, OUTD2, OUTD3, and OUTD4) are output from the fourth latch circuit 58-4, the selector circuit 60 selectively outputs the grayscale bits for the consecutive three lines. In the case of selecting the grayscale data retained in the first to third latch circuits 58-1 to 58-3 based on the select control signal, the selector circuit 60 selectively outputs the grayscale bits OUTA1 to OUTC1, OUTA2 to OUTC2, OUTA3 to OUTC3, and OUTA4 to OUTC4 for the consecutive three lines.

The MLS operation results converted by the MLS signal conversion circuit 62 are supplied to the signal electrode driver circuit 64. The signal electrode driver circuit 64 supplies voltage based on the MLS operation results to the output pad 66. In the case of performing grayscale display by pulse width modulation, the output pad 66 may be driven by the signal electrode driver circuit 64 after pulse width modulating the MLS operation results.

Figure 6:
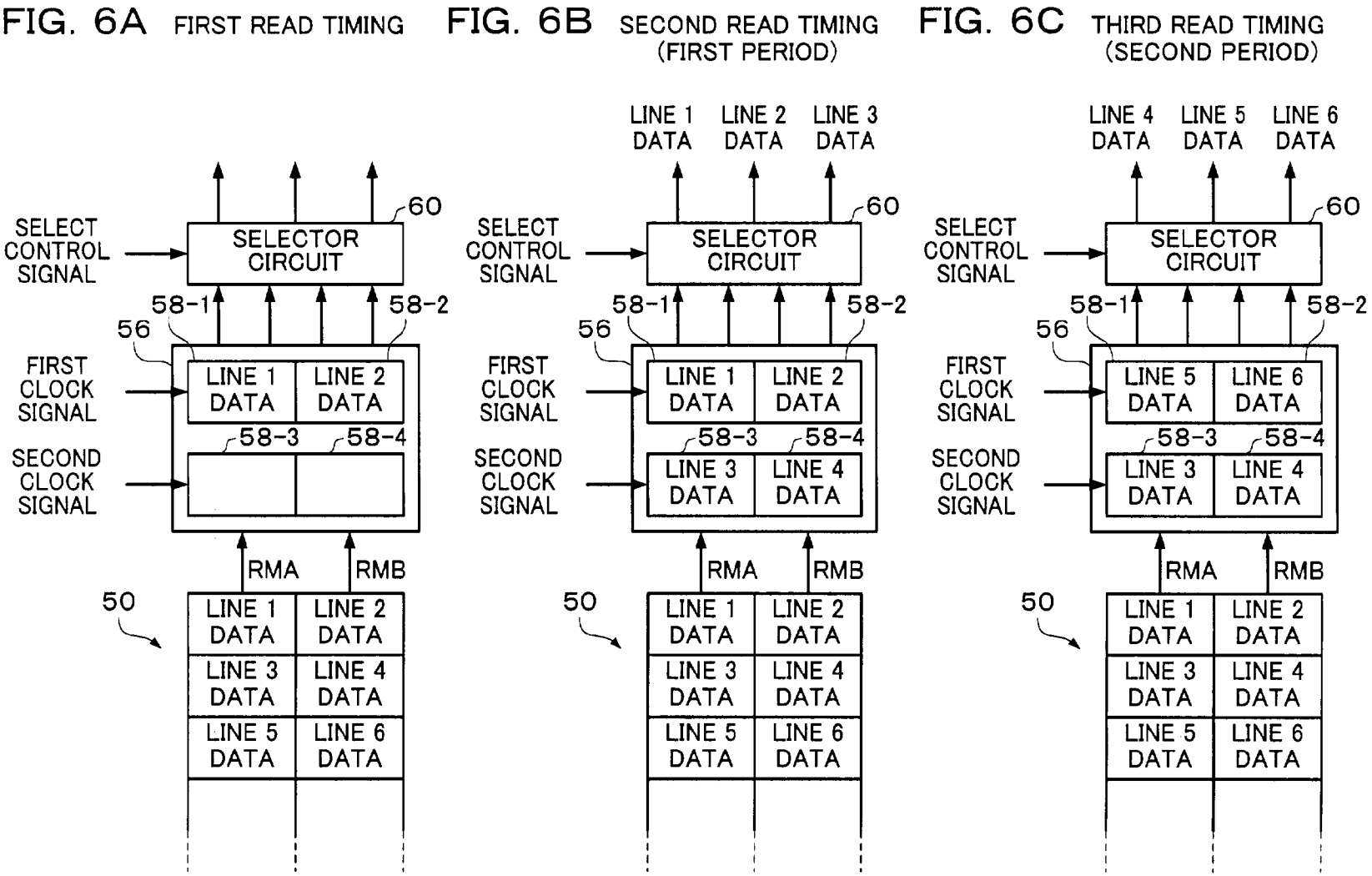
FIGS. 6A to 6C are diagrams for describing the read operation in the case of performing 3MLS in the signal driver according to the present invention.

FIGS. 6A to 6C are diagrams for describing the read operation in the signal driver according to the present invention in the case of performing 3MLS.

In this example, the line 1 data (display data for first line) to the line 6 data (display data for sixth line) are display data for consecutive six lines.

As shown in FIG. 6A, the line 1 data (display data for first line) and the line 2 data (display data for second line) are read from the display data RAM 50 by the first read operation, and respectively retained in the first latch circuit 58-1 and the second latch circuit 58-2 based on the first clock signal.

As shown in FIG. 6B, the line 3 data (display data for third line) and the line 4 data (display data for fourth line) are read from the display data RAM 50 by the second read operation, and respectively retained in the third latch circuit 58-3 and the fourth latch circuit 58-4 based on the second clock signal.

The selector circuit 60 outputs data for consecutive three lines (the line 1 data to the line 3 data retained in the first to third latch circuits 58-1 to 58-3) by the select control signal in a first period. The data for the three lines is input to the MLS signal conversion circuit.

As shown in FIG. 6C, the line 5 data (display data for fifth line) and the line 6 data (display data for sixth line) are read from the display data RAM 50 by the third read operation, and respectively retained in the first latch circuit 58-1 and the second latch circuit 58-2 based on the first clock signal.

The selector circuit 60 outputs data for consecutive three lines (the line 4 data to the line 6 data retained in the fourth latch circuit 58-4, the first latch circuit 58-1, and the second latch circuit 58-2) by the select control signal in a second period after the first period. The data for the three lines is input to the MLS signal conversion circuit.

This enables the line 4 data to be used to generate the MLS operation results together with the line data read at the next read timing without reading the line 4 data remaining in the first period. Therefore, an increase in power consumption due to redundant read operations from the RAM can be prevented by using an extremely simple configuration.

The latch circuit 56 and the selector circuit 60 of the signal driver are described below in detail.

Figure 7:
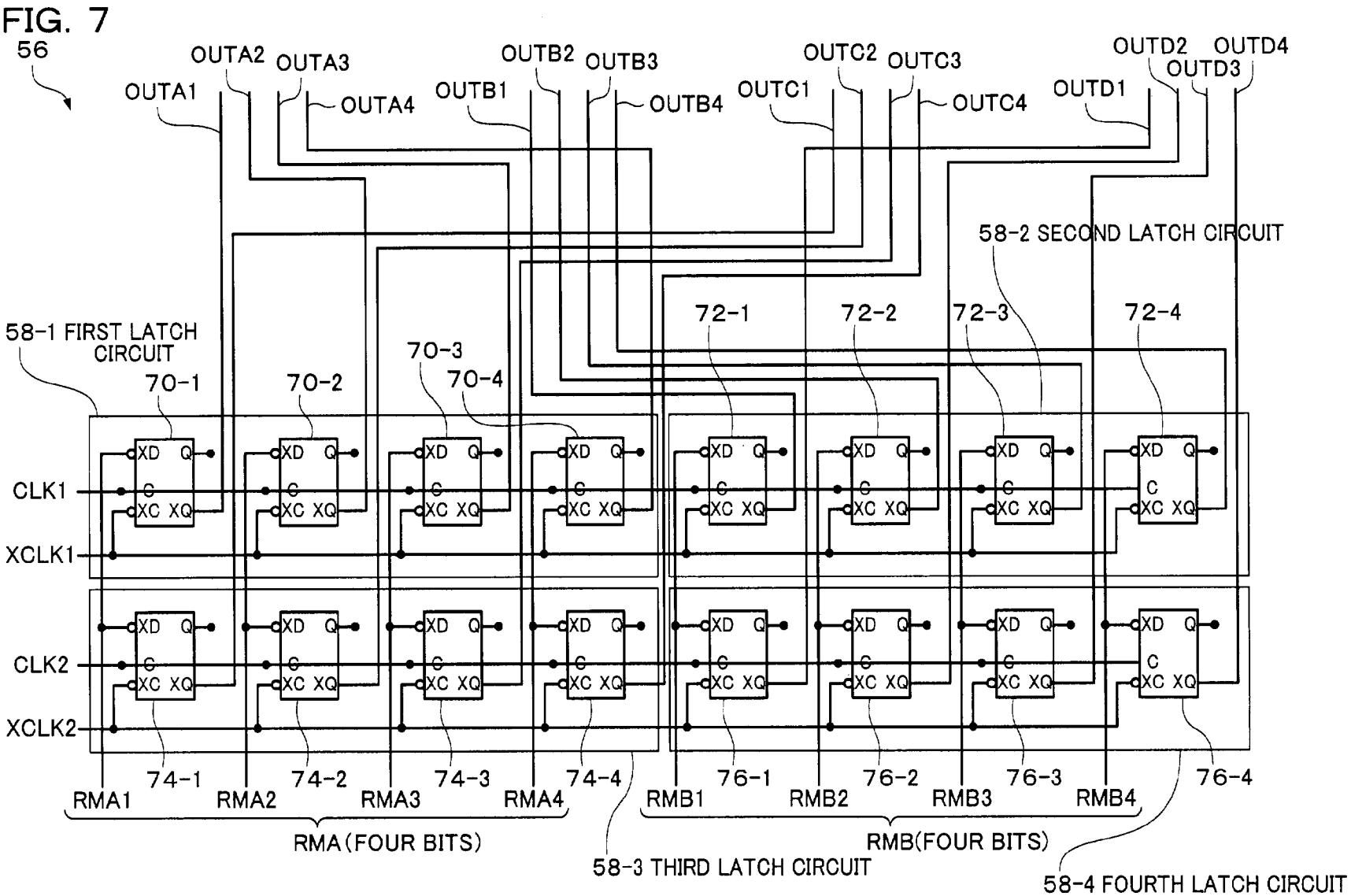
FIG. 7 is a circuit diagram showing an example of a latch circuit.

FIG. 7 is a circuit diagram of the latch circuit 56.

The data RMA1 to RMA4 (four bits) for odd-numbered lines and data RMB1 to RMB4 (four bits) for even-numbered lines are input to the latch circuit 56 from the display data RAM 50.

The first latch circuit 58-1 includes flip-flop (hereinafter abbreviated as "FF") circuits 70-1 to 70-4. The second latch circuit 58-2 includes FF circuits 72-1 to 72-4. The third latch circuit 58-3 includes FF circuits 74-1 to 74-4. The fourth latch circuit 58-4 includes FF circuits 76-1 to 76-4.

The FF circuits 70-1 to 70-4, 72-1 to 72-4, 74-1 to 74-4, and 76-1 to 76-4 have the same configuration. For example, the FF circuit 70-1 has an inverted data terminal XD, a clock terminal C, an inverted clock terminal XC, a data output terminal Q, and an inverted data output terminal XQ. The FF circuit 70-1 retains the logic level of a signal supplied to the inverted data terminal XD at a falling edge of a signal input to the clock terminal C (at a rising edge of a signal input to the inverted clock terminal XC), and outputs signals having a corresponding logic level from the data terminal Q and the inverted data terminal XQ.

In the FF circuits 70-1 to 70-4 of the first latch circuit 58-1, a first clock signal CLK1 is supplied to the clock terminal C. A first inverted clock signal XCLK1 generated by inverting the first clock signal CLK1 is supplied to the inverted clock terminal XC. The data RMA1 to RMA4 for an odd-numbered line is supplied to the inverted data terminal XD. The grayscale bits OUTA1 to OUTA4 are output from the inverted data output terminals XQ of the FF circuits 70-1 to 70-4. The grayscale bits OUTA1 to OUTA4 are supplied to the selector circuit 60.

In the FF circuits 72-1 to 72-4 of the second latch circuit 58-2, the first clock signal CLK1 is supplied to the clock terminal C. The first inverted clock signal XCLK1 generated by inverting the first clock signal CLK1 is supplied to the inverted clock terminal XC. The data RMB1 to RMB4 for even-numbered line is supplied to the inverted data terminal XD. The grayscale bits OUTB1 to OUTB4 are output from the inverted data output terminals XQ of the FF circuits 72-1 to 72-4. The grayscale bits OUTB1 to OUTB4 are supplied to the selector circuit 60.

In the FF circuits 74-1 to 74-4 of the third latch circuit 58-3, a second clock signal CLK2 is supplied to the clock terminal C. A second inverted clock signal XCLK2 generated by inverting the second clock signal CLK2 is supplied to the inverted clock terminal XC. The data RMA1 to RMA4 for odd-numbered line is supplied to the inverted data terminal XD. The grayscale bits OUTC1 to OUTC4 are output from the inverted data output terminals XQ of the FF circuits 74-1 to 74-4. The grayscale bits OUTC1 to OUTC4 are supplied to the selector circuit 60.

In the FF circuits 76-1 to 76-4 of the fourth latch circuit 58-4, the second clock signal CLK2 is supplied to the clock terminal C. The second inverted clock signal XCLK2 generated by inverting the second clock signal CLK2 is supplied to the inverted clock terminal XC. The data RMB1 to RMB4 for even-numbered line is supplied to the inverted data terminal XD. The grayscale bits OUTD1 to OUTD4 are output from the inverted data output terminals XQ of the FF circuits 76-1 to 76-4. The grayscale bits OUTD1 to OUTD4 are supplied to the selector circuit 60.

The second clock signal CLK2 may be a signal having a frequency ½ times the frequency of the first clock signal CLK1 by dividing the first clock signal CLK1 from a rising edge of the first clock signal CLK1. In this case, the retaining timing of the latch circuit can be controlled by using a simple configuration without causing the falling edges of the first and second clock signals CLK1 and CLK2 to overlap.

Figure 8:
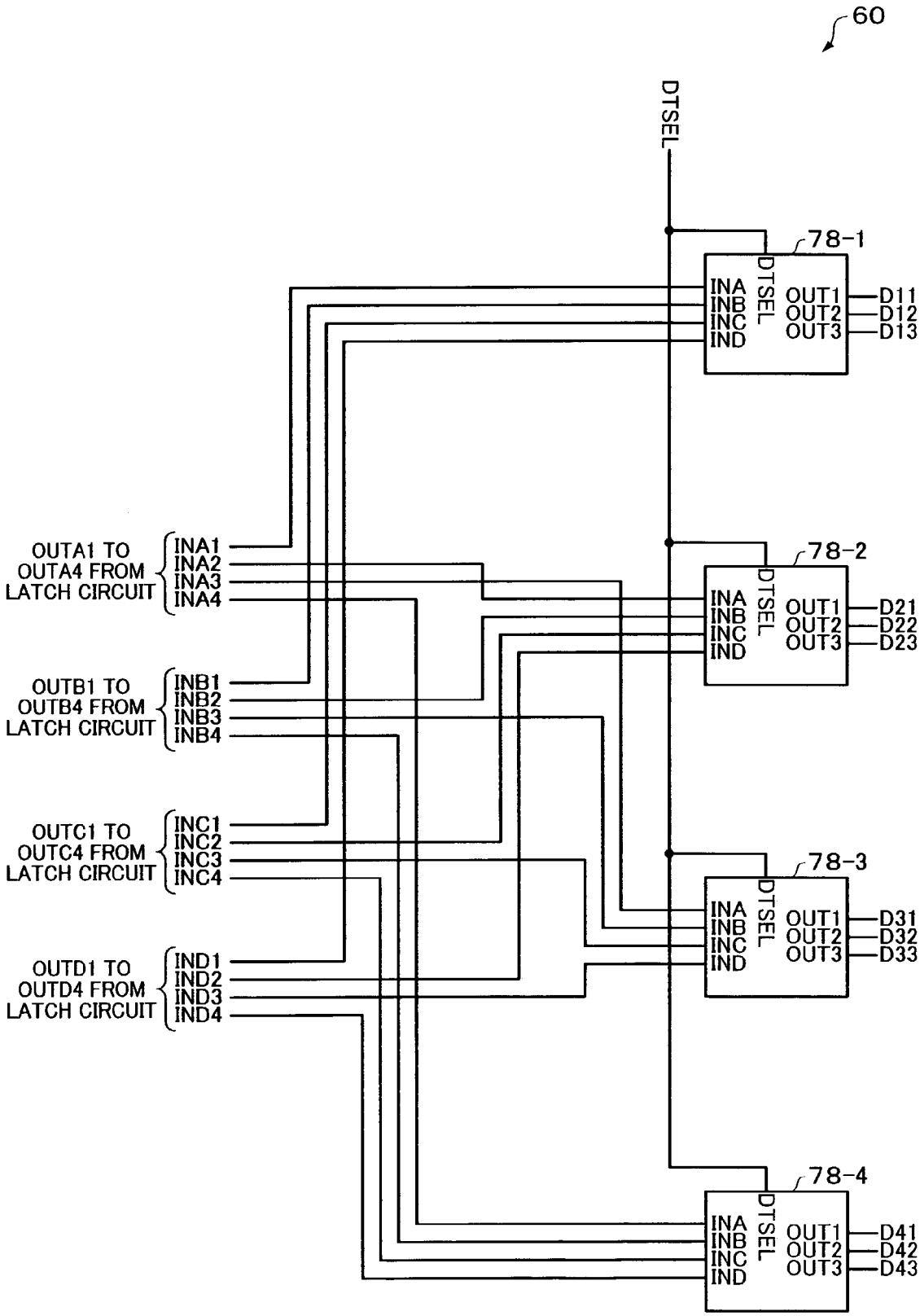
FIG. 8 is a circuit diagram showing an example of a selector circuit.

FIG. 8 is a circuit diagram of the selector circuit 60.

The selector circuit 60 includes four-input, three-output select circuits 78-1 to 78-4 controlled by a select control signal DTSEL.

The four-input, three-output select circuits 78-1 to 78-4 have the same configuration. For example, the four-input, three-output select circuit 78-1 is operated according to a truth table shown in FIG. 9. Specifically, when the logic level of the select control signal DTSEL is "H", input signals IND, INA, and INB among input signals INA to IND are output in that order as the output signals OUT1 to OUT3. When the logic level of the select control signal DTSEL is "L", the input signals INA, INB, and INC among the input signals INA to IND are output in that order as the output signals OUT1 to OUT3.

Figure 10:
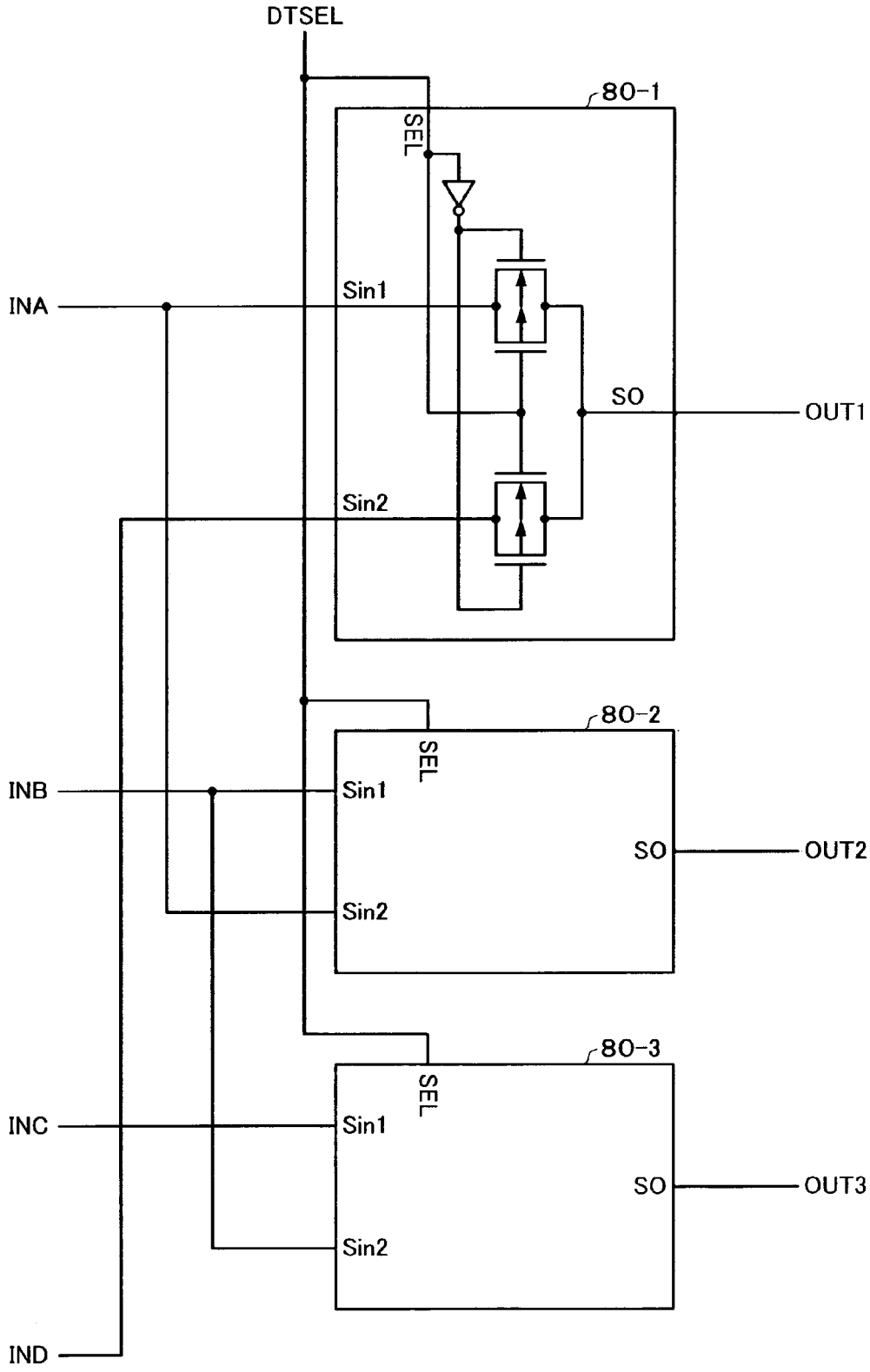
FIG. 10 is a circuit diagram showing the four-input, three-output select circuit.

FIG. 10 shows a configuration example of the four-input, three-output select circuit 78-1.

The four-input, three-output select circuit 78-1 includes two-input, one-output select circuits 80-1, 80-2, and 80-3. The two-input, one-output select circuits 80-1 to 80-3 have the same configuration. For example, the two-input, one-output select circuit 80-1 outputs either a data input signal Sin1 or Sin2 as a data output signal SO based on a switch signal SEL. In more detail, the two-input, one-output select circuit 80-1 outputs the data input signal Sin2 as the data output signal SO when the logic level of the switch signal SEL is "H", and outputs the data input signal Sin1 as the data output signal SO when the logic level of the switch signal SEL is "L".

In the two-input, one-output select circuit 80-1, the input signal INA is input as the input signal Sin1, the input signal IND is input as the input signal Sin2, and the output signal OUT1 is output as the output signal SO. In the two-input, one-output select circuit 80-2, the input signal INB is input as the input signal Sin1, the input signal INA is input as the input signal Sin2, and the output signal OUT2 is output as the output signal SO. In the two-input, one-output select circuit 80-3, the input signal INC is input as the input signal Sin1, the input signal INB is input as the input signal Sin2, and the output signal OUT3 is output as the output signal SO. The select control signal DTSEL is input to the two-input, one-output select circuits 80-1 to 80-3 as the switch signal SEL.

This configuration enables the four-input, three-output select circuit 78-1 to achieve the functions of the truth table shown in FIG. 9.

In FIG. 8, the grayscale bits OUTA1 to OUTA4 from the latch circuit 56 are input to the selector circuit 60 including the four-input, three-output select circuits 78-1 to 78-4 as the input signals INA1 to INA4. The grayscale bits OUTB1 to OUTB4 are input to the selector circuit 60 as the input signals INB1 to INB4. The grayscale bits OUTC to OUTC4 are input to the selector circuit 60 as the input signals INC1 to INC4. The grayscale bits OUTD1 to OUTD4 are input to the selector circuit 60 as the input signals IND1 to IND4.

The input signals INA1, INB1, INC1, and IND1 are input to the four-input, three-output select circuit 78-1, and output signals D11 to D13 are output from the four-input, three-output select circuit 78-1. The output signals D11 to D13 are supplied to the MLS signal conversion circuit 62.

The input signals INA2, INB2, INC2, and IND2 are input to the four-input, three-output select circuit 78-2, and output signals D21 to D23 are output from the four-input, three-output select circuit 78-2. The output signals D21 to D23 are supplied to the MLS signal conversion circuit 62.

The input signals INA3, INB3, INC3, and IND3 are input to the four-input, three-output select circuit 78-3, and output signals D31 to D33 are output from the four-input, three-output select circuit 78-3. The output signals D31 to D33 are supplied to the MLS signal conversion circuit 62.

The input signals INA4, INB4, INC4, and IND4 are input to the four-input, three-output select circuit 78-4, and output signals D41 to D43 are output from the four-input, three-output select circuit 78-4. The output signals D41 to D43 are supplied to the MLS signal conversion circuit 62.

This configuration enables the selector circuit 60 to selectively output the grayscale data for consecutive three lines from among the grayscale data retained in the latch circuit 56 based on the select control signal DTSEL. The selector circuit 60 is capable of selectively outputting the grayscale data in bit units.

Figure 11:
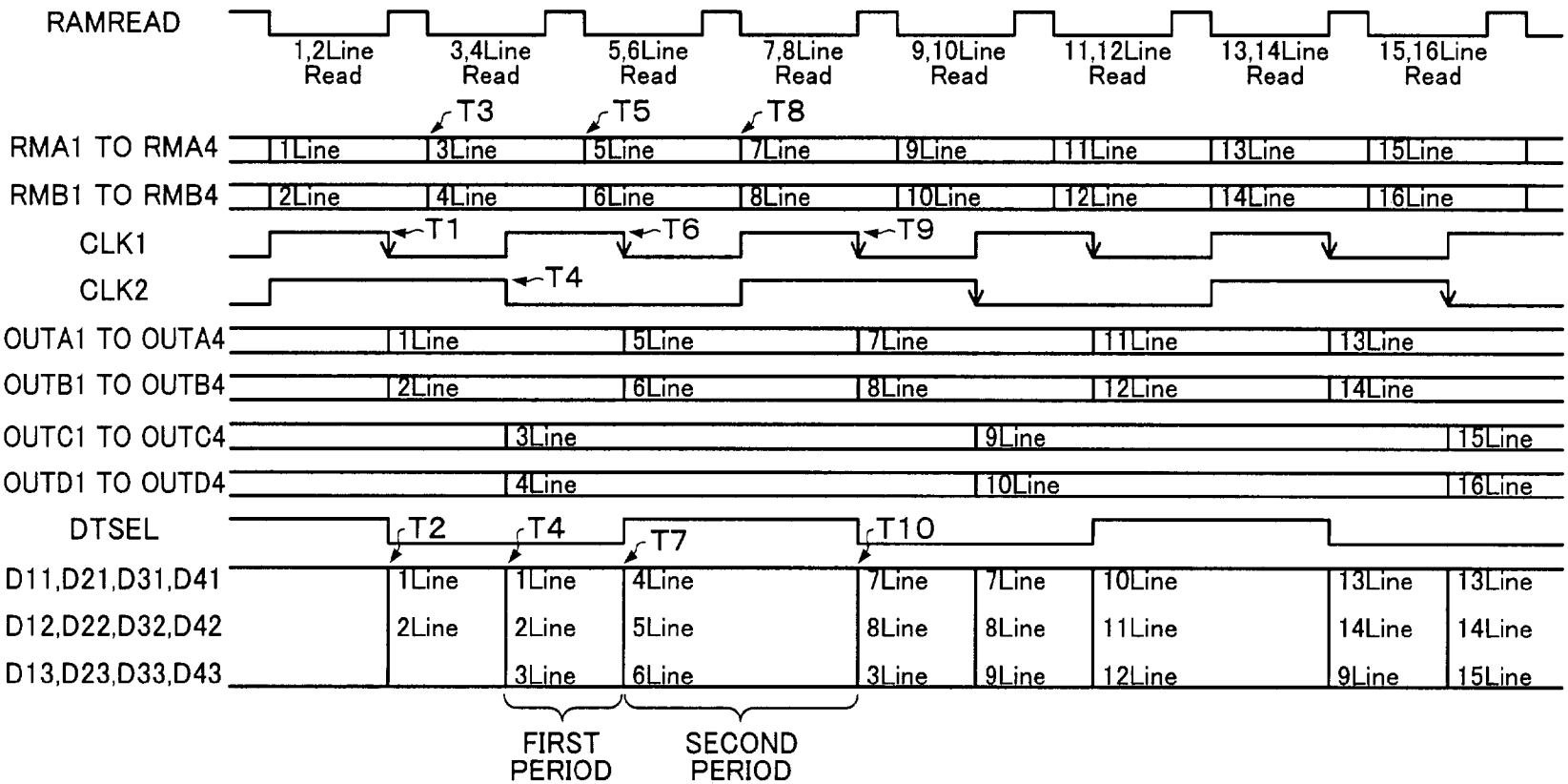
FIG. 11 is a timing chart showing an example of the operation of the signal driver according to the present invention.

FIG. 11 shows an example of a timing chart showing the operation of the signal driver shown in FIG. 5.

This operation example shows a period in which the line data (grayscale data) is read from the display data RAM 50 and the grayscale data for consecutive three lines is selectively output from the selector circuit 60.

A RAM read signal RAMREAD is a read control signal of the display data RAM 50 and generated by a RAM control circuit (not shown). The RAM read signal RAMREAD also functions as a precharge signal. The bit lines are precharged when the logic level of the RAM read signal RAMREAD is "H". The data stored in the memory cells connected with the activated word line is read through the bit lines when the logic level of the RAM read signal RAMREAD is "L".

The data RMA1 to RMA4 indicates each bit of the data for odd-numbered lines read from the display data RAM 50 and input to the latch circuit 56 shown in FIG. 7. The data RMB1 to RMB4 indicates each bit of the data for even-numbered lines read from the display data RAM 50 and input to the latch circuit 56 shown in FIG. 7.

The first and second clock signals CLK1 and CLK2 are input to the first to fourth latch circuits 58-1 to 58-4 shown in FIG. 7.

The grayscale bits OUTA1 to OUTA4 are latch outputs of the first latch circuit 58-1 shown in FIG. 7. The grayscale bits OUTB1 to OUTB4 are latch outputs of the second latch circuit 58-2 shown in FIG. 7. The grayscale bits OUTC1 to OUTC4 are latch outputs of the third latch circuit 58-3 shown in FIG. 7. The grayscale bits OUTD1 to OUTD4 are latch outputs of the fourth latch circuit 58-4 shown in FIG. 7.

The select control signal DTSEL controls selection by the selector circuit 60.

The output signals D11 to D41, D12 to D42, and D13 to D43 are signals selectively output from the selector circuit 60 shown in FIG. 8. In more detail, the output signals D11 to D13 are signals selectively output from the four-input, three-output select circuit 78-1. The output signals D21 to D23 are signals selectively output from the four-input, three-output select circuit 78-2. The output signals D31 to D33 are signals selectively output from the four-input, three-output select circuit 78-3. The output signals D41 to D43 are signals selectively output from the four-input, three-output select circuit 78-4.

When the logic level of the RAM read signal RAMREAD is changed from "H" to "L", the data stored in the memory cells connected to the activated word line is read as the data RMA1 to RMA4 and the data RMB1 to RMB4. In FIG. 5, the grayscale data for two lines consisting of an odd-numbered line and an even-numbered line is read at the same time. The grayscale data for each line can be sequentially read in two line units by sequentially activating each word line each time the data is read from the RAM.

The data RMA1 to RMA4 and RMB1 to RMB4 is latched at a falling edge of the first clock signal CLK1 in the selector circuit 60 (T1). Therefore, the grayscale bits OUTA1 to OUTA4 and OUTBl to OUTB4 output from the first and second latch circuits 58-1 and 58-2 are the line 1 data and the line 2 data, respectively.

Since the logic level of the select control signal DTSEL is "L", the input signals INA1 to INA4 and INB1 to INB4 are output from the selector circuit 60. Therefore, the selector circuit 60 outputs the line 1 data and the line 2 data (T2).

The data RMA1 to RMA4 and RMB1 to RMB4 then read from the display data RAM 50 are the line 3 data and the line 4 data (T3). The line 3 data and the line 4 data are latched at a falling edge of the second clock signal CLK2 in the selector circuit 60 (T4). Therefore, the grayscale bits OUTC1 to OUTC4 and OUTD1 to OUTD4 output from the third and fourth latch circuits 58-3 and 58-4 are the line 3 data and the line 4 data, respectively.

Since the logic level of the select control signal DTSEL is "L", the input signals INC1 to INC4 are output from the selector circuit 60. Therefore, the selector circuit 60 outputs the line 3 data together with the line 1 data and the line 2 data latched at a falling edge of the first clock signal CLK1 (T4, first period).

The data RMA1 to RMA4 and RMB1 to RMB4 then read from the display data RAM 50 are the line 5 data and the line 6 data (T5). The line 5 data and the line 6 data are latched at a falling edge of the first clock signal CLK1 in the selector circuit 60 (T6). Therefore, the grayscale bits OUTA1 to OUTA4 and OUTB1 to OUTB4 output from the first and second latch circuits 58-1 and 58-2 are the line 5 data and the line 6 data, respectively.

Since the logic level of the select control signal DTSEL is "H", the input signals INA1 to INA4, INB1 to INB4, INC1 to INC4, and IND1 to IND4 are output from the selector circuit 60 in the order from IND1 to IND4, INA1 to INA4, and INB1 to INB4. Therefore, the selector circuit 60 outputs the line 5 data and the line 6 data together with the line 4 data latched at a falling edge of the second clock signal CLK2 (T7, second period).

The data RMA1 to RMA4 and RMB1 to RMB4 then read from the display data RAM 50 are the line 7 data and the line 8 data (T8). The line 7 data and the line 8 data are latched at a falling edge of the first clock signal CLK1 in the selector circuit 60 (T9). Therefore, the grayscale bits OUTA1 to OUTA4 and OUTB1 to OUTB4 output from the first and second latch circuits 58-1 and 58-2 are the line 7 data and the line 8 data, respectively.

Since the logic level of the select control signal DTSEL is "L", the input signals INA1 to INA4, INB1 to INB4, INC1 to INC4, and IND1 to IND4 are output from the selector circuit 60 in that order. Therefore, the selector circuit 60 outputs the line 7 data and the line 8 data (T10).

In the case where the grayscale data is read from the display data RAM 50 in two line units, the selector circuit 60 outputs the grayscale data for consecutive three lines by repeating the above operations. This enables unnecessary reading of the grayscale data for three lines necessary for generating the 3MLS operation results to be omitted, whereby an increase in power consumption accompanied by unnecessary read operations can be prevented. Moreover, since the first clock signal CLK1 and the second clock signal CLK2 obtained by dividing the first clock signal CLK1 from a rising edge of the first clock signal CLK1 are used, latch control can be performed by using an extremely simple configuration.

These embodiments are not limited by the number of simultaneously selected lines. The these embodiments may be applied to a signal driver (display driver circuit) which drives a signal electrode of a display panel having a plurality of scan electrodes and a plurality of signal electrodes which intersect each other by using MLS in which m (m is an integer of two or more) scan electrodes are simultaneously selected. In this case, the signal driver may include a display data RAM (RAM) which stores grayscale data (display data) for driving a display panel and from which the grayscale data is read in units of n lines (n is a natural number, m>n), first to q-th latch circuits (q is a natural number, $2n \leqq q$ and m<q) which retain the grayscale data for q lines read from the display data RAM, a selector circuit which selectively outputs the grayscale data for consecutive m lines from among the grayscale data retained in the first to q-th latch circuits based on a given select control signal, and a signal electrode driver circuit which drives the signal electrode by using given operation results based on the grayscale data for m lines selectively output from the selector circuit.

Specifically, the grayscale data for q ($2n \leqq q$ and m>q) lines (m is the number of simultaneously selected lines) is retained by several times of read operations, and the selector circuit is controlled in the same manner as in 3MLS in which the data is read in two line units. This enables the selector circuit to output the grayscale data for the consecutive m lines, whereby it is unnecessary to perform excess read operations from the RAM. Therefore, an increase in power consumption accompanied by unnecessary read operations can be prevented.

The signal driver which includes the MLS signal conversion circuit for driving display by using 3MLS based on the grayscale data for the consecutive three lines read by the above efficient read operations is described below in detail.

3. Signal Driver

The signal driver 14 uses two voltage levels for driving the signal electrode by employing the concept of the virtual electrode, and drives the liquid crystal panel by using 3MLS at a contrast equal to 4MLS. The signal driver 14 decodes and outputs the MLS operation results obtained in advance without performing complicated 4MLS operations each time the signal electrode is driven, whereby the circuit configuration can be significantly simplified. In more detail, the MLS operations are performed in advance on the display patterns for three lines and the dummy display pattern corresponding to the display patterns for three lines by using orthogonal functions specified by the combination of the scan pattern of the simultaneously selected three scan electrodes and the dummy scan pattern corresponding to the scan pattern. Decoder circuits are provided for decoding and outputting the MLS operation results in response to a field signal. This enables the decoder circuits to be provided for each bit of grayscale data, thereby eliminating the need for a conventional complicated MLS operation circuit.

An MLS decoder (decoder circuit in a broad sense; MLS signal conversion circuit in FIG. 5) which decodes and outputs the 4MLS operation results by using the scan pattern of the simultaneously selected three lines and the display patterns for three lines corresponding to the scan pattern is described below. The MLS decoder is included in the signal driver 14.

3.1 MLS Decoder

Figure 12:
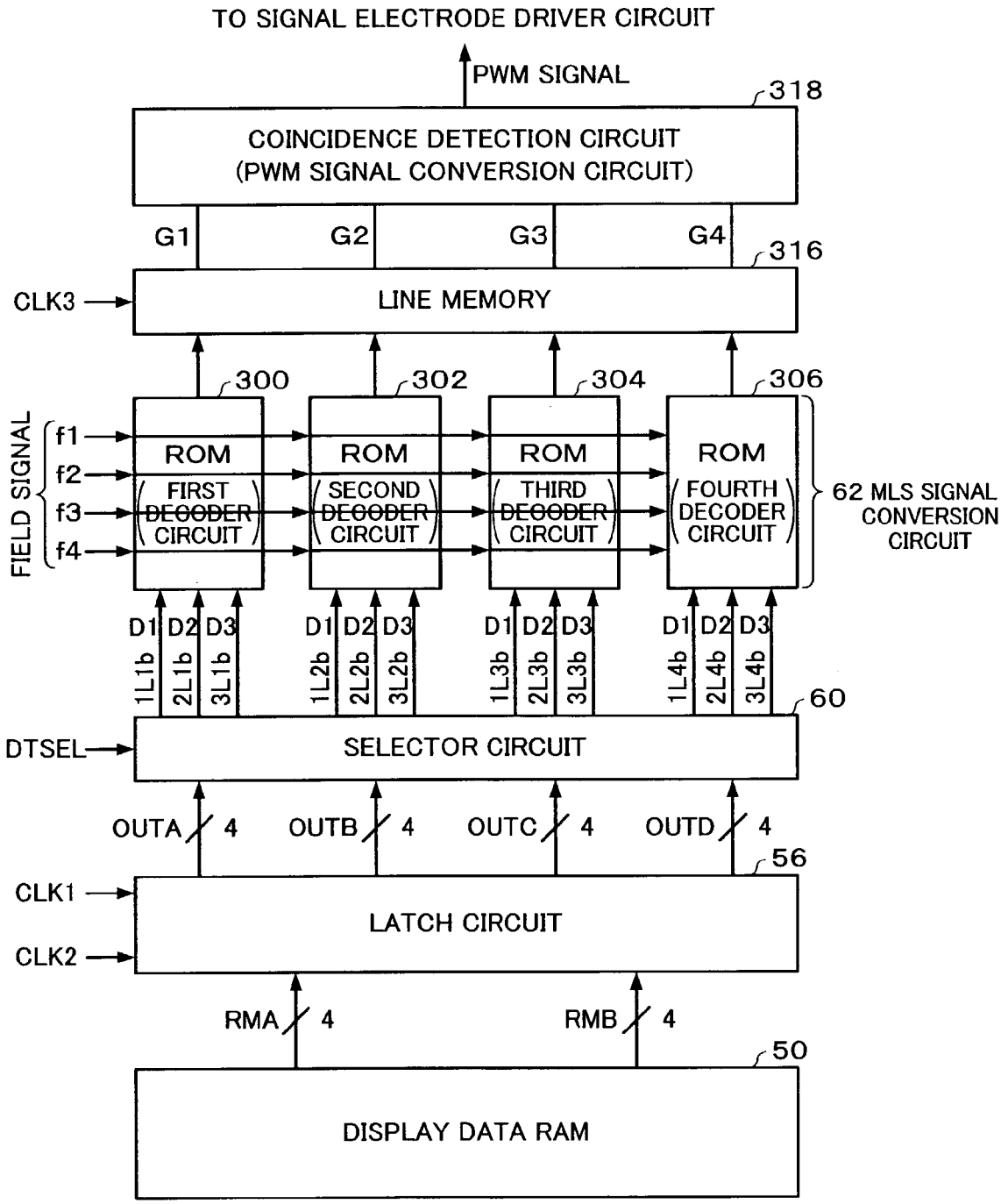
FIG. 12 is a block diagram showing main components of the signal driver including an MLS decoder.

FIG. 12 shows main components of the signal driver including the MLS decoder.

The signal driver 14 drives the signal electrodes. FIG. 12 shows a configuration of a unit of one signal electrode (segment). The following description is given on the assumption that the number of bits p of grayscale data is four ($2^4$=16 grayscales)

The MLS decoder may be formed by using one or more read only memories (hereinafter abbreviated as "ROMs"). Each ROM is provided for each bit of the grayscale data. In the case where the grayscale data is four bits, the MLS decoder may be formed by using four ROMs.

The signal driver 14 includes ROMs (first to fourth (pth) decoder circuits in a broad sense) 300, 302, 304, and 306 as the MLS decoders in units of bits of the grayscale data. A display pattern corresponding to the scan pattern of the simultaneously selected three scan electrodes is supplied to the ROMS 300, 302, 304, and 306 in bit units. Therefore, the rth ($1 \leqq r \leqq p$, r is a natural number) bits of the grayscale data for three lines corresponding to the scan pattern of the simultaneously selected three scan electrodes are input to the rth decoder circuit. In more detail, if the 4-bit grayscale data consists of the first to fourth bits, the first bits (three bits consisting of 1L1b to 3L1b) of the grayscale data corresponding to the display pattern for three lines are supplied to the ROM 300. The second bits (three bits consisting of 1L2b to 3L2b of the grayscale data corresponding to the display pattern for three lines are supplied to the ROM 302. The third bits (three bits consisting of 1L3b to 3L3b) of the grayscale data corresponding to the display pattern for three lines are supplied to the ROM 304. The fourth bits (three bits consisting of 1L4b to 3L4b of the grayscale data corresponding to the display pattern for three lines are supplied to the ROM 306. The ROMs 300, 302, 304, and 306 output two-valued signals (decoded output signals) in response to field signals f1 to f4 by using the MLS operation results determined in field units.

The signal driver 14 reads the grayscale data for three lines, four bits each, supplied to the ROMs 300, 302, 304, and 306 from the display data RAM 50. The grayscale data for consecutive three lines is read from the display data RAM 50, as shown in FIGS. 5 to 11. Therefore, the grayscale data for odd-numbered lines and even-numbered lines read from the display data RAM 50 is supplied to the latch circuit 56 as the data RMA and RMB.

As shown in FIG. 7, the latch circuit 56 latches the read data based on the first and second clock signals CLK1 and CLK2. The grayscale data for the consecutive three lines among the latched read data is selectively output from the selector circuit 60. The selector circuit 60 outputs the grayscale data in bit units of each line in order to allow the ROMs to decode and output.

The signal driver 14 may include a line memory 316 which retains the decoded results output from the ROMs 300, 302, 304, and 306 in bit units. The line memory 316 latches the decoded results based on a third clock signal CLK3.

The MLS operation results decoded and output from the ROMs 300, 302, 304, and 306 are pulse width modulated and output to the signal electrode. In FIG. 12, the MLS operation results decoded and output from the ROMs 300, 302, 304, and 306 are latched by the line memory 316 and pulse width modulated by a pulse width modulated (PWM) signal conversion circuit 318.

The PWM signal conversion circuit 318 generates a PWM signal having a pulse width corresponding to the MLS operation results latched by the line memory 316, and outputs the PWM signal to the signal electrode driver circuit (not shown) provided for each signal electrode. The PWM signal conversion circuit 318 may be formed so that the PWM signal conversion circuit 318 outputs the PWM signal having a pulse width corresponding to the MLS operation results by changing a signal level of coincidence detection results based on the coincidence detection results between a count value which is counted by a clock for pulse width clocking and the decoded and output MLS operation results.

The signal electrode driver circuit drives the corresponding signal electrode based on the PWM signal.

These embodiments are not limited by the number of bits of grayscale data or the number of bits of MLS operation results. The signal driver may have the same configuration in the case where the number of bits is other than in the example described above.

The MLS decoder is described below in detail.

3.1.1 3MLS

In these embodiments, the scan pattern of the simultaneously selected three scan electrodes is output to the signal electrode using the 4MLS operation results for the scan pattern of four scan electrodes by employing the concept of a dummy scan electrode (virtual electrode).

Figure 13:
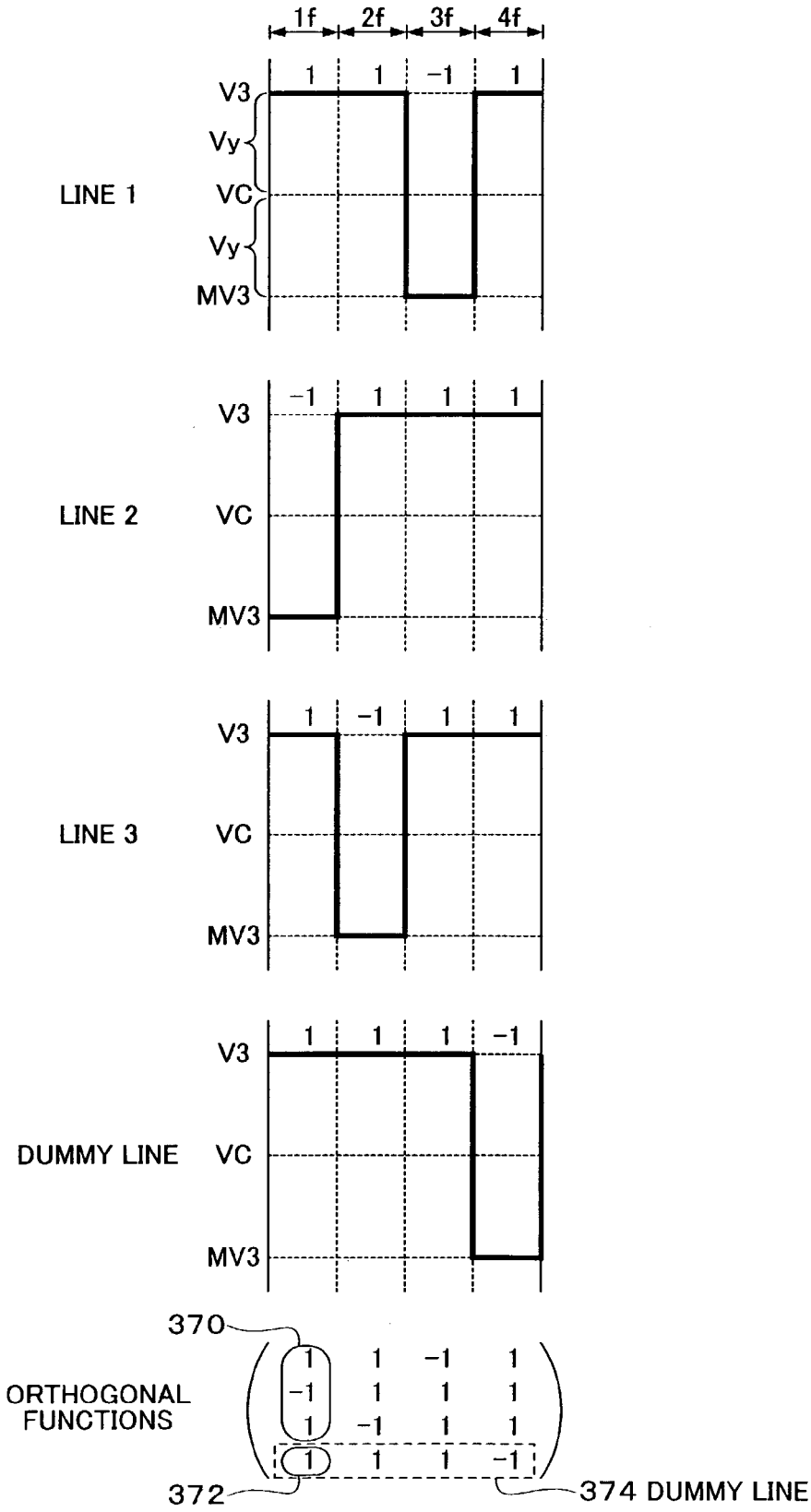
FIG. 13 is a waveform charts showing examples of scan patterns output to the scan electrodes.

FIG. 13 shows examples of the scan patterns output to the scan electrodes.

In FIG. 13, the scan patterns output to the simultaneously selected three scan electrodes are illustrated in each field as common waveforms (scan electrode drive waveforms, COM waveforms) The scan driver outputs one of voltage levels V3 (=VC+Vy) and MV3 (=VC−Vy) having the same amplitude (=Vy) and different polarities with respect to a center voltage level VC to the scan electrodes in each field.

The voltage level V3 is referred to as "1", and the voltage level MV3 is referred to as "−1". In the case where one of the simultaneously selected scan electrodes is "−1" in 1f (field) to 3f, the scan pattern is prescribed so that the dummy scan electrode (dummy line) becomes "−1" in 4f.

As shown in FIG. 14, the scan driver 16 is capable of outputting each scan pattern shown in FIG. 13 to the scan electrodes by supplying the voltage level V3 corresponding to "1" or the voltage level MV3 corresponding to "−1" to each scan electrode based on the field signals f1 to f4 corresponding to four states expressed by two bits of field setting signals F1 and F2.

The scan patterns supplied to the simultaneously selected three scan electrodes may be expressed as quartic orthogonal functions as shown in FIG. 13 by allowing the scan patterns in 1f to 4f in each line to make up components in each row. This orthogonal function is prescribed in each field by a scan pattern 370 of the simultaneously selected three scan electrodes and a scan pattern 372 of the virtual scan electrode (dummy line) corresponding to the scan pattern 370. Therefore, a scan pattern 374 of the dummy scan electrode is expressed in the fourth row. The orthogonal functions can be expressed in the same manner in the case where the number of simultaneously selected scan electrodes is s (s is an integer).

The segment waveforms in the case of 4MLS by using such scan patterns are described below.

FIGS. 15A to 15H and FIGS. 16A to 16H schematically show the segment waveforms in the case of 4MLS.

The segment waveforms are illustrated for all the display patterns corresponding to the above scan patterns.

In the case of 4MLS, the number of voltage levels necessary for driving the signal electrode is generally five. The voltage levels in each field are indicated by "−2", "−1", "0", "1", and "2". The voltage levels are referred to as V2, V1, VC, MV1, and MV2. The voltage level VC which can be shared between the signal driver and the scan driver is referred to as "0", the voltage level V2 is referred to as "2", the voltage level V1 is referred to as "1", the voltage level MV2 is referred to as "−2", and the voltage level MV2 is referred to as "2". The five values of voltage levels V2, V1, VC, MV1, and MV2 satisfy the following relational equations.

$$V2=VC+2Vx \quad (1)$$

$$V1=VC+Vx \quad (2)$$

$$MV1=VC-Vx \quad (3)$$

$$MV2=VC-2Vx \quad (4)$$

Voltage applied to a liquid crystal layer in each line and each field is illustrated for each display pattern. The voltage applied to the liquid crystal layer is the difference between the voltage level of the scan electrode and the voltage level of the signal electrode. In the case of a display pattern (0, 0, 1, 1) shown in FIG. 15D, since the scan electrode is at the voltage level V3 in if in the first line as shown FIG. 13 and the signal electrode is at the voltage level MV1, the voltage applied to the liquid crystal layer is (V3−MV1) (=VC+Vy−

(VC−Vx)=Vy+Vx). Similarly, since the scan electrode is at the voltage level V3 and the signal electrode is at the voltage level V1 in 2f in the first line, the voltage applied to the liquid crystal layer is Vy−Vx. In the case of a display pattern (1, 1, 0, 1) shown in FIG. 16F, the voltage applied to the liquid crystal layer is VC in 1f in the first line. The voltage applied to the liquid crystal layer is Vy+2Vx in 2f in the first line.

Evaluation values corresponding to the root-mean-square values of the voltage applied to the liquid crystal layer in each line are shown in FIGS. 15A to 15H and FIGS. 16A to 16H taking only the selected period into consideration. These evaluation values are the sum of the squares of the applied voltages in each field. As a result, the evaluation values consist of two values expressed by $Voff^2$ or $Von^2$.

Figure 15A:
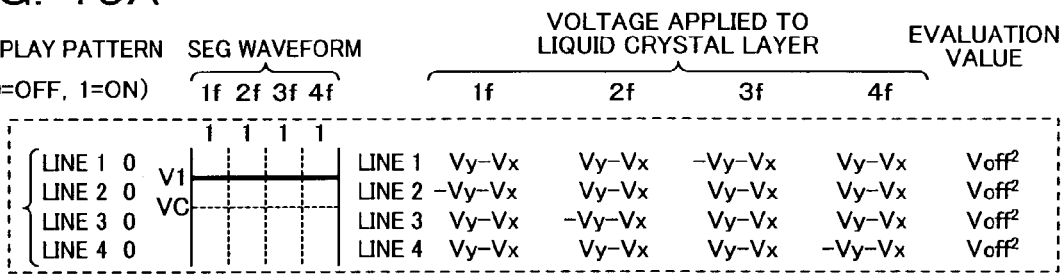
FIGS. 15A to 15H are diagrams illustrative of the segment waveforms, voltages applied to a liquid crystal layer, and evaluation values in the case of 4MLS.
Figure 15B:
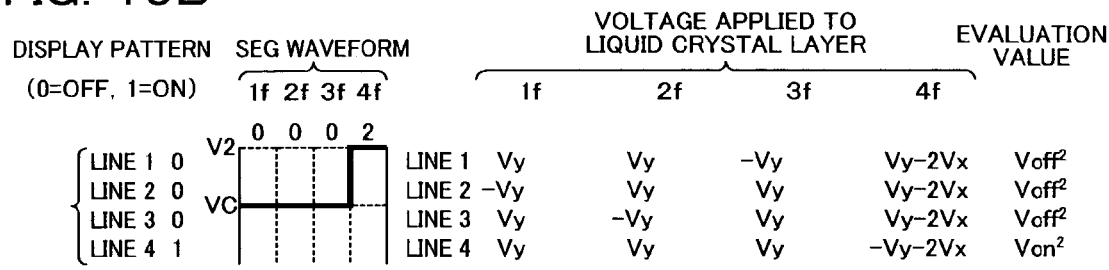
Figure 15C:
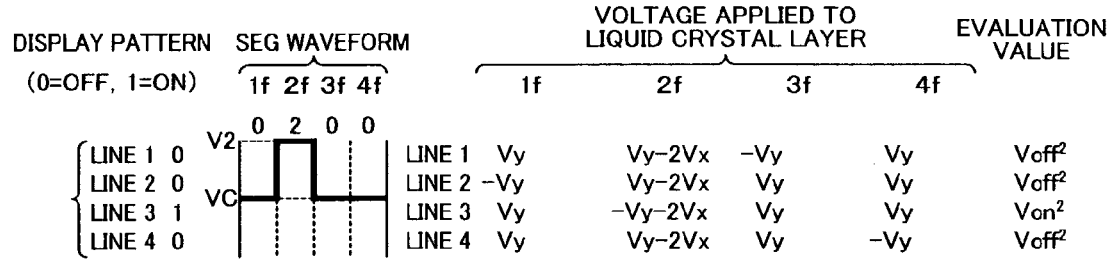
Figure 15D:
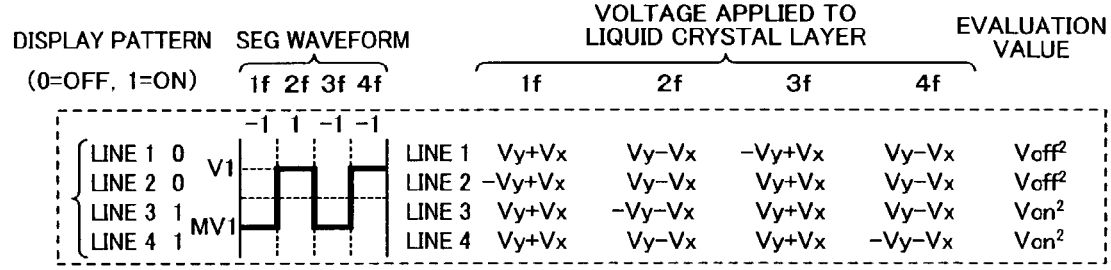
Figure 15E:
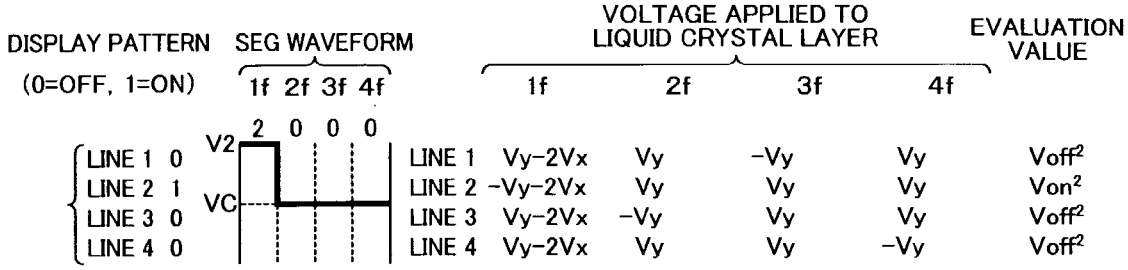
Figure 15F:
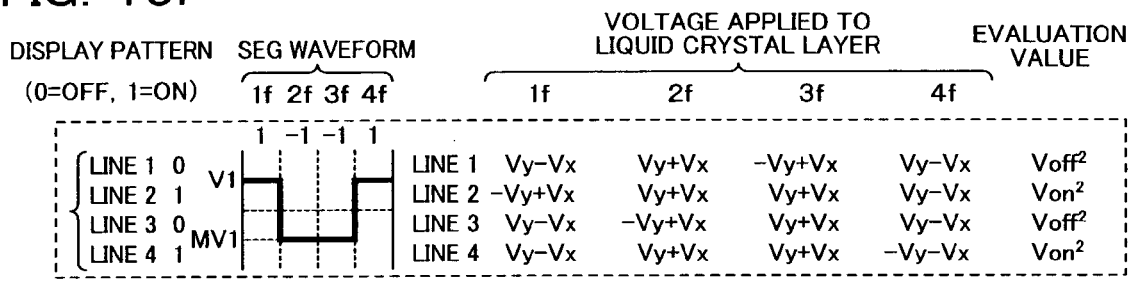
Figure 15G:
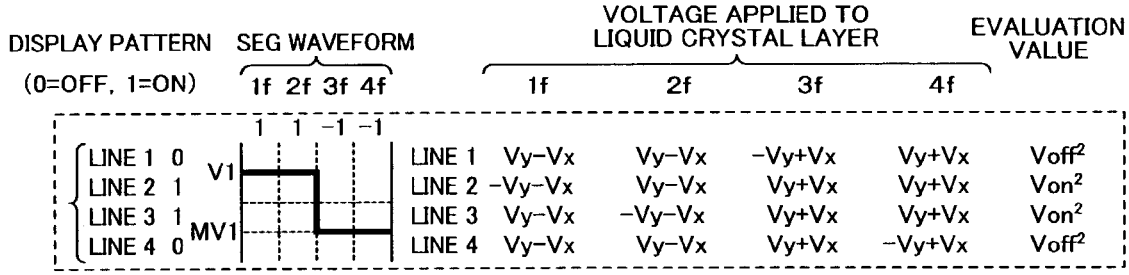
Figure 15H:
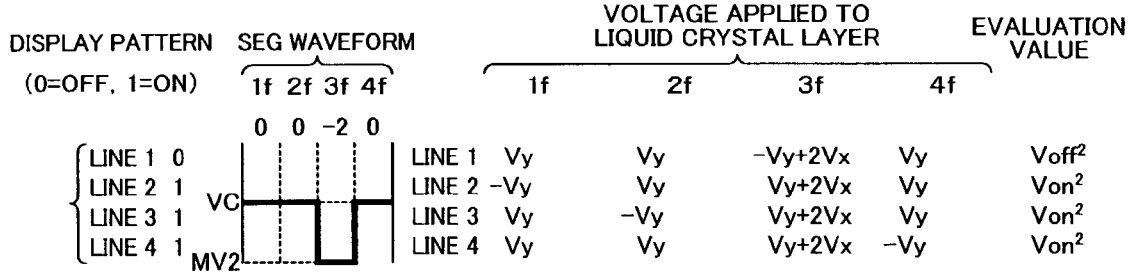
Figure 16E:
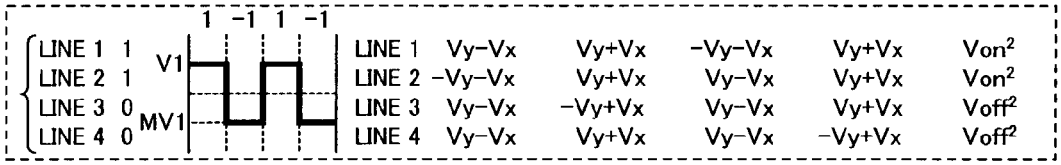
Figure 16F:
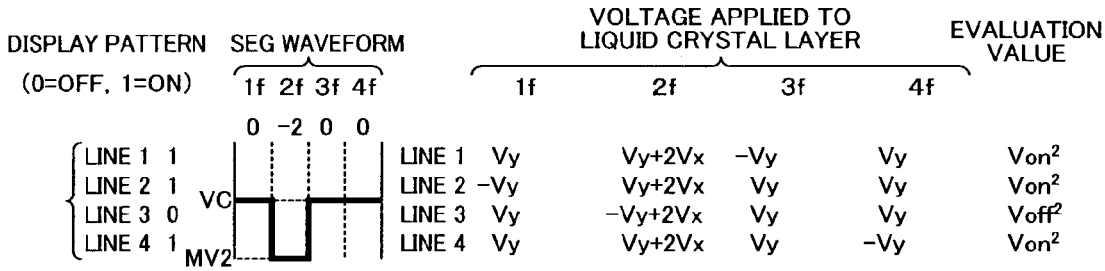
Figure 16G:
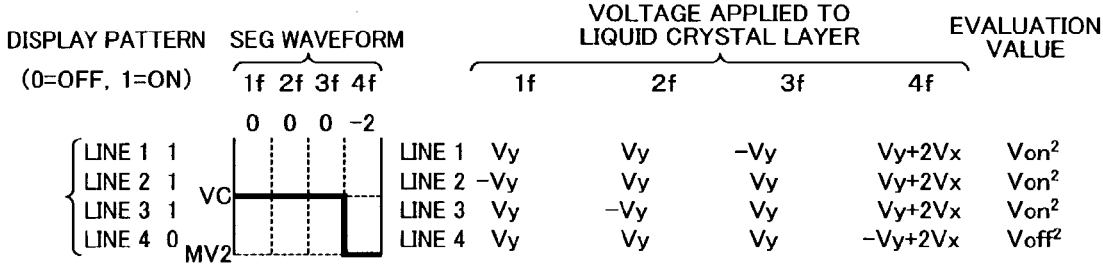
Figure 16H:
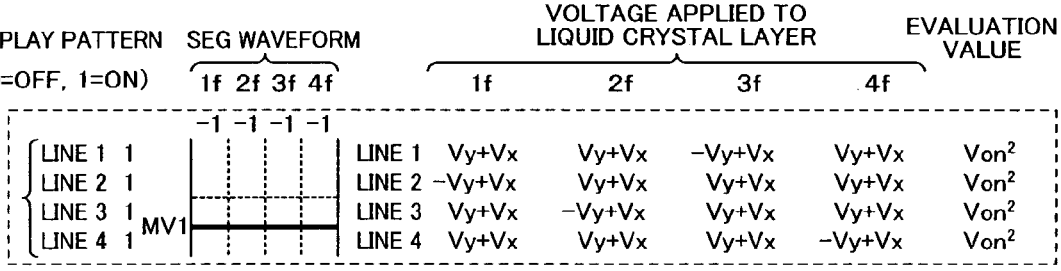
Figure 17A:
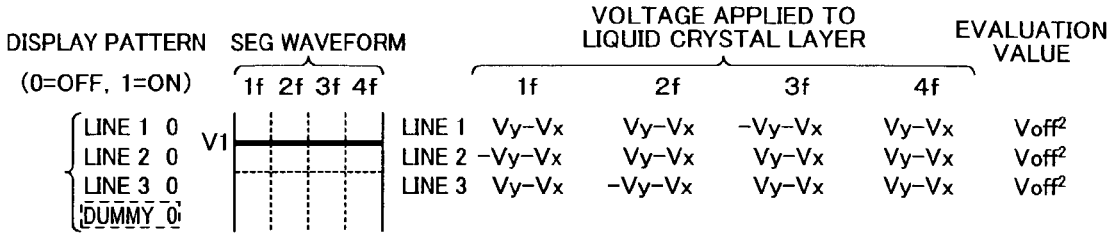
Figure 17B:
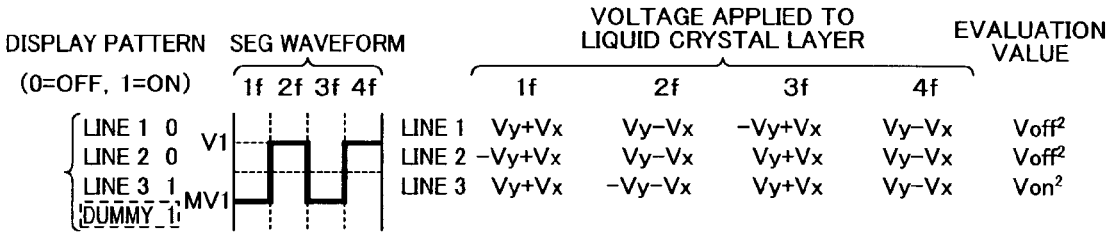
Figure 17C:
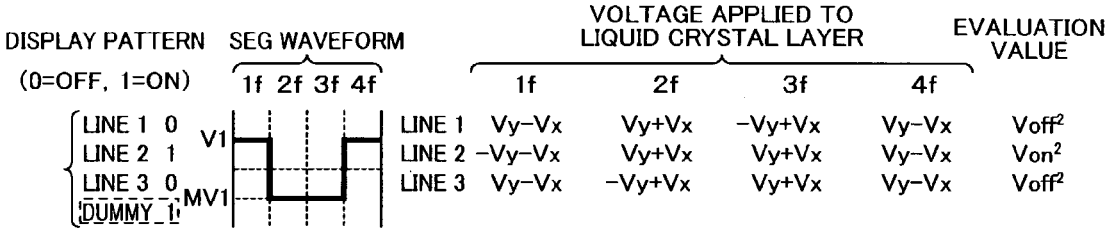
Figure 17D:
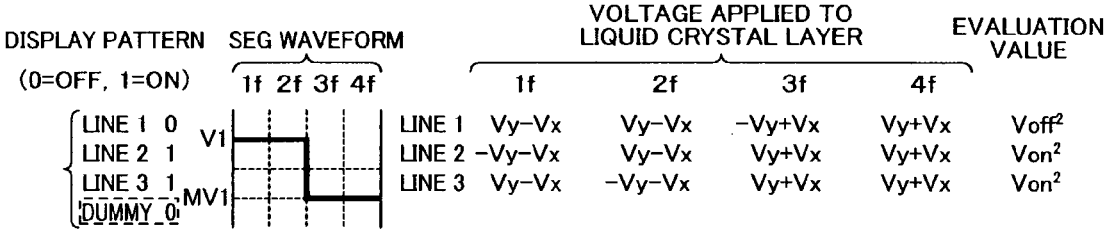

As shown in FIGS. 15A to 15H and FIGS. 16A to 16H, each two display patterns have the same pattern in the first line to the third line. For example, the first line to the third line of the display pattern shown in FIG. 15A are the same as the first line to the third line of the display pattern shown in FIG. 15B. This also applies to the display patterns shown in FIG. 15C and FIG. 15D, FIG. 15E and FIG. 15F, . . . , FIG. 16A and FIG. 16B, . . . , and FIG. 16G and FIG. 16H. For example, the evaluation values in the first line to the third line are the same, but only the evaluation values in the fourth line differ in FIG. 15A and FIG. 15B. This also applies to the display patterns shown in FIG. 15C and FIG. 15D, FIG. 15E and FIG. 15F, . . . , FIG. 16A and FIG. 16B, . . . , and FIG. 16G and FIG. 16H.

In one of the display patterns in each combination, the segment waveform uses only two values of the voltage levels V1 and MV1. Specifically, these display patterns consist of (0, 0, 0, 0) (FIG. 15A), (0, 0, 1, 1) (FIG. 15D), (0, 1, 0, 1) (FIG. 15F), (0, 1, 1, 0) (FIG. 15G), (1, 0, 0, 1) (FIG. 16B), (1, 0, 1, 0) (FIG. 16C), (1, 1, 0, 0) (FIG. 16E), and (1, 1, 1, 1) (FIG. 16H) (eight patterns in total). Therefore, contrast equal to 4MLS can be realized in the first line to the third line by using these eight patterns. Moreover, the voltage level of the segment waveform corresponding to each display pattern can be expressed by two values.

3.1.2 Decode

FIGS. 17A to 17H schematically show the segment waveforms by using 3MLS according to the present invention.

Each display pattern is the segment waveforms selected from the segment waveforms shown in FIGS. 15A to 15H and FIGS. 16A to 16H as described above.

In the case of outputting these segment waveforms by using 3MLS, the display pattern in the fourth line corresponding to the display patterns in the first line to the third line is determined as the dummy display pattern (dummy pattern). In FIGS. 17A to 17H, the dummy pattern is selected so that the number of "1" of the display patterns in each line is an even number (0, 2, or 4).

The MLS operation results corresponding to the segment waveforms in which the voltage levels consist of two values as shown in FIGS. 17A to 17H can be obtained by the MLS operations on the display patterns for four lines in the same manner as in 4MLS using the orthogonal functions shown in FIG. 13. Therefore, contrast equal to 4MLS at two voltage levels can be realized by outputting the voltage level V1 or MV1 in each field using the resulting MLS operation results.

FIG. 18 shows the relationship between the display pattern and the MLS operation results according to the present invention.

ON and OFF of the display pattern respectively correspond to "−1" and "1". Either "1" or "−1" is selected as the dummy pattern so that the number of "1" or "−1" is an even number (0, 2, or 4).

As shown in FIG. 18, each display pattern by 4MLS can be covered by using only the eight patterns shown in FIGS. 17A to 17H. Therefore, the 4MLS operation results can be obtained by the MLS operations on each display pattern shown in FIG. 18. For example, "−1" is selected as a dummy pattern 402 corresponding to a display pattern 400 so that the number of "1" or "−1" of each element of the display pattern 400 and the dummy pattern 402 is an even number (0, 2, or 4). MLS operation results (given operation results) 404 are obtained by matrix operations (MLS operations, given operations) on the display pattern 400 and the dummy pattern 402 based on the orthogonal functions shown in FIG. 13. The MLS operation results 404 are the 4MLS operation results and either "2" or "−2" is obtained in each field. The segment waveform shown in FIG. 17B can be expressed by associating "2" and "−2" with the voltage levels V1 and MV1, respectively.

Therefore, a truth table described below can be obtained for the MLS decoder which decodes and outputs in each field.

FIG. 19 shows an example of a truth table of the MLS decoder according to the present invention.

"1" and "0" in the display patterns D1 to D3 respectively correspond to ON and OFF. A decoded output OUT is at the voltage level V1 when "H", and at the voltage level MV1 when "L". 1f is specified by allowing the field signal f1 to be at a logic level "H". 2f is specified by allowing the field signal f2 to be at a logic level "H". 3f is specified by allowing the field signal f3 to be at a logic level "H". 4f is specified by allowing the field signal f4 to be at a logic level "H".

D1 indicates the display pattern in the first line of the simultaneously selected three scan electrodes. D2 indicates the display pattern in the second line of the simultaneously selected three scan electrodes. D3 indicates the display pattern in the third line of the simultaneously selected three scan electrodes.

According to this truth table, the following decode functions can be realized. In the case where the field signal f1 is "H", if the display patterns D1 to D3 are (1,0,0), MLS operation results 412 by the orthogonal functions shown in FIG. 13 are obtained by using the dummy pattern 410 (ON (−1)) corresponding to the display pattern (ON (−1), OFF (1), OFF (1)) in FIG. 18. Therefore, a logic level "L" is output as the decoded output OUT in If so that the voltage level MV1 corresponding to the voltage level "−2" shown in FIG. 18 is output.

Grayscale display can be realized by providing the decoder circuits having the same decoding functions in units of bits of the grayscale data. In these embodiments, the ROMs 300, 302, 304, and 306 output the decoded results according to the above truth table.

As described above, the decoder circuits which output the decoded output signals corresponding to the fields from the 4MLS operation results based on the scan pattern for the simultaneously selected three scan electrodes and the display pattern for three lines corresponding to the scan pattern are provided in units of bits. Therefore, 3MLS can be realized without generating a dummy display pattern corresponding to the virtual electrode or the like. Moreover, two voltage levels are made necessary for driving the signal electrode in 3MLS, and contrast equal to 4MLS can be realized. Furthermore, since it is unnecessary to perform the MLS operations, the configuration can be significantly simplified.

3.2 Pulse Width Modulation

As described above, the signal driver in these embodiments latches the MLS operation results decoded and output from the ROMs 300, 302, 304, and 306 by the fourth line memory 316, pulse width modulates the MLS operation results, and outputs the MLS operation results to the signal electrode.

In these embodiments, the signal of the decoded and output MLS operation results is pulse width modulated by using the confirmation circuit 318. The confirmation circuit 318 changes the pulse width based on the coincidence detection results between the signal of the decoded and output MLS operation results and the count value counted by a clock for pulse width clocking. The signal of the MLS operation results is supplied to the confirmation circuit 318 as a PWM change point setting signal.

Figure 20:
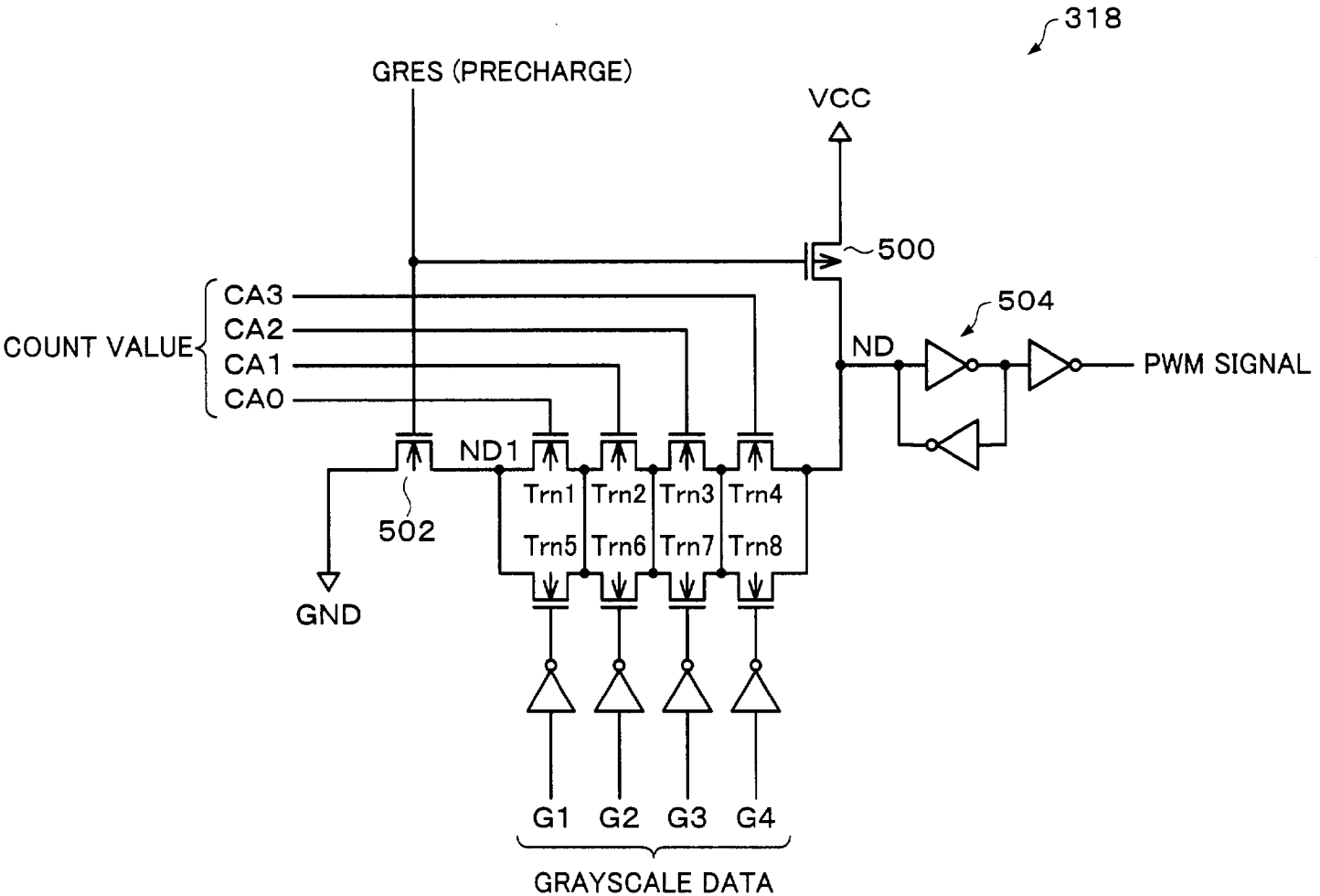
FIG. 20 is a circuit diagram showing a confirmation circuit.

FIG. 20 shows an example of the confirmation circuit 318.

Each bit CA0 to CA3 (CA0 is LSB) of the count value to be counted by a clock GCP for pulse width clocking and each bit G1 to G4 of the MLS operation results are input to the confirmation circuit 318. The PWM signal is changed based on the coincidence detection results.

The confirmation circuit 318 includes a p-type MOS transistor (switching element in a broad sense) 500 which is connected to a power supply voltage level VCC at a source terminal. A reset signal GRES as a precharge signal is supplied to a gate electrode of the p-type MOS transistor 500. An output node ND is connected with a drain terminal of the p-type MOS transistor 500. As the reset signal GRES, a latch pulse LP which is changed corresponding to one horizontal scan period may be used.

The confirmation circuit 318 includes an n-type MOS transistor 502 which is connected to a ground voltage level GND at a source terminal. The reset signal GRES is applied to a gate electrode of the n-type MOS transistor 502. A node ND1 is connected with a drain terminal of the n-type MOS transistor 502.

First to fourth n-type MOS transistors (Trn1 to Trn4) connected in series and fifth to eighth n-type MOS transistors (Trn5 to Trn8) connected in series are inserted between the output node ND and the node ND1. A drain terminal and a source terminal of the Trn1 are respectively connected with a drain terminal and a source terminal of the Trn5. A drain terminal and a source terminal of the Trn2 are respectively connected with a drain terminal and a source terminal of the Trn6. A drain terminal and a source terminal of the Trn3 are respectively connected with a drain terminal and a source terminal of the Trn7. A drain terminal and a source terminal of the Trn4 are respectively connected with a drain terminal and a source terminal of the Trn8.

Signals of each bit CA0 to CA3 of the count value are applied to gate electrodes of the Trn1 to Trn4. Each bit G1 to G4 of the MLS operation results (decoded output signal in a broad sense) are inverted and applied to gate electrodes of the Trn5 to Trn8.

A latch circuit 504 is connected with the output node ND. The latch circuit 504 outputs the PWM signal corresponding to the logic level of the output node ND.

Figure 21:
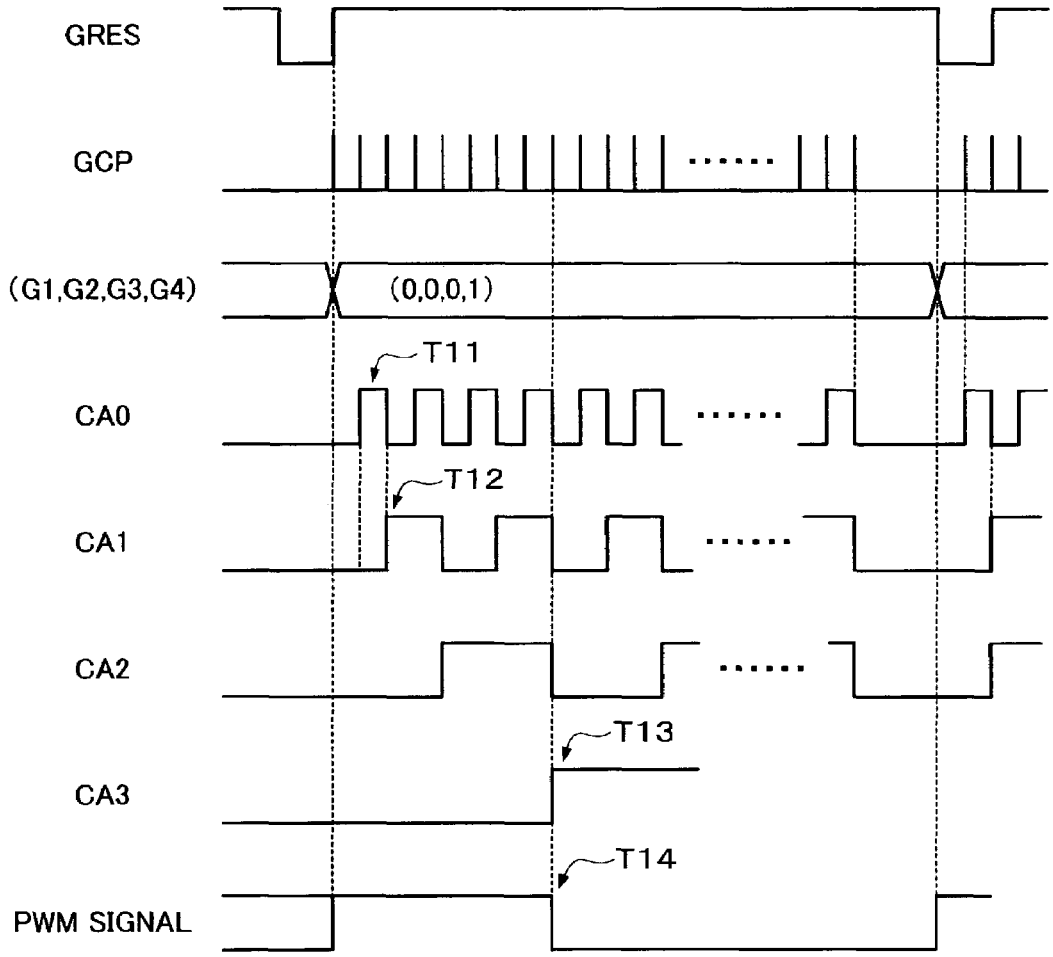
FIG. 21 is a timing chart showing operation timing of the confirmation circuit.

FIG. 21 shows an example of a timing chart of the confirmation circuit 318.

The reset signal GRES is a pulse which is changed to a logic level "L" in a field cycle, for example. When the logic level of the reset signal GRES is "L", the output node ND is at the power supply voltage level VCC through the p-type MOS transistor 500, whereby the logic level of the output node ND is retained in the latch circuit 504. At this time, the logic level of the PWM signal becomes "H". The n-type MOS transistor 502 is turned OFF. A counter (not shown) is reset by the reset signal GRES in a period in which the output node ND is precharged, whereby the count value becomes "0". The counter counts the 4-bit count value in synchronization with the clock GCP. The count value is applied to the gate electrodes of the Trn1 to Trn4 as the signals CA0 to CA3.

When the logic level of the reset signal GRES becomes "H", the p-type MOS transistor 500 is turned OFF and the n-type MOS transistor 502 is turned ON. Therefore, the node ND1 is at the ground voltage level GND. The output node ND is retained at the logic level "H".

The output node ND and the node ND1 are electrically connected when one of the Trn1 and Trn5 is turned ON, one of the Trn2 and Trn6 is turned ON, one of the Trn3 and Trn7 is turned ON, and one of the Trn4 and Trn8 is turned ON.

In the case where the grayscale data is "8" ((G1,G2,G3, G4)= (0, 0, 0, 1)), the Trn5 to Trn7 are turned ON and only the Trn8 is turned OFF. If the LSB is the bit CA0 among the bits CA0 to CA3 of the count value, the bit CA1 becomes "1" when the count value is "1" (T11), whereby only the Trn1 is turned ON and the Trn2 to Trn4 are turned OFF. Since only the bit CA2 becomes "1" when the count value becomes "2" (T12), only the Trn2 is turned ON and the Trn1, Trn3, and Trn4 are turned OFF. The Trn4 is turned ON when the bit CA3 becomes "1" (T13), whereby the output node ND and the node ND1 are electrically connected. Specifically, the output node ND and the node ND1 are electrically connected at the eighth clock GCP. This allows the output node ND to be at the ground voltage level GND, whereby the PWM signal is changed to the logic level "L" (T14). This state is maintained by the latch circuit 504 until the output node ND is precharged, even if the count value is increased.

FIGS. 22A to 22F show examples of the segment waveforms in the case of implementing 16-grayscale display by PWM in the display driver circuit according to the present invention.

ON and OFF states of the display pattern are respectively indicated by "1" and "0". "1" and "−1" of the segment waveform respectively indicate "V1" and "MV1".

Figure 22A:
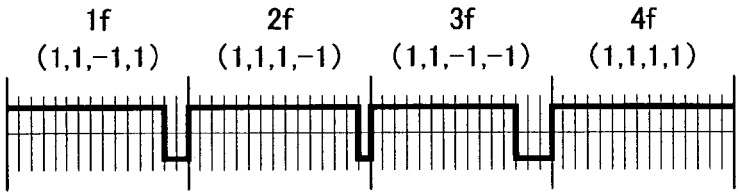
FIGS. 22A to 22F are waveform charts showing examples of segment waveforms in the case of implementing 16-gray-scale display in the signal driver according to the present invention by PWM.
Figure 22B:
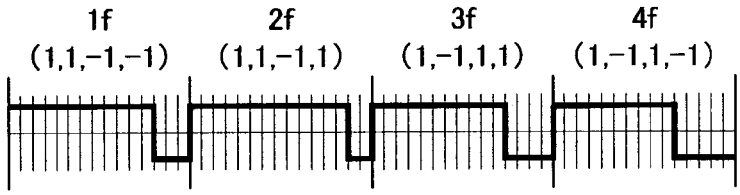
Figure 22C:
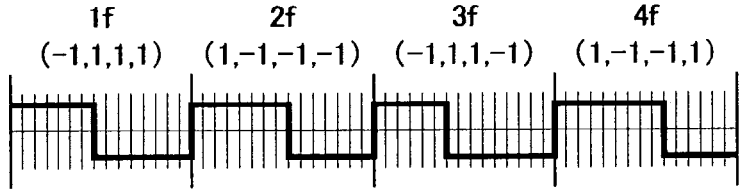
Figure 22D:
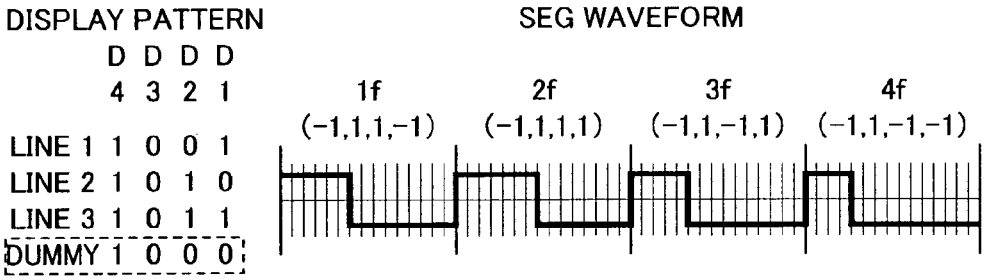
Figure 22E:
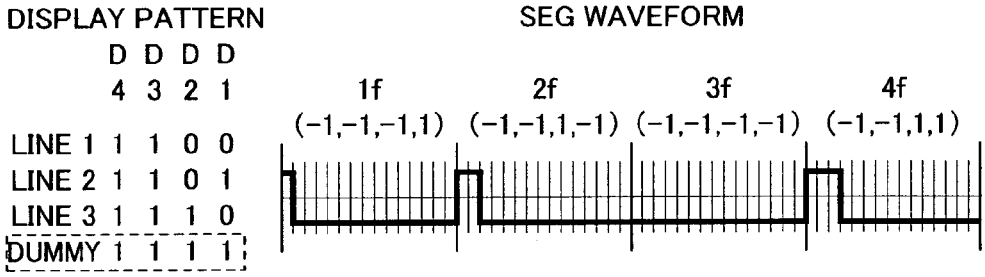
Figure 22F:
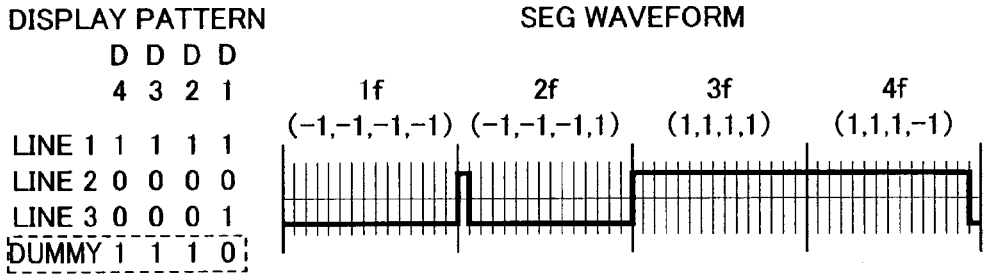

In the display pattern shown in FIG. 22B, when the MLS operation results become (1, 1, −1, −1) (=12) in 1f, the logic level of the PWM signal is changed to "L" at the twelfth segment. In FIG. 22E, when the MLS operation results become (−1, −1, 1, 1) (=3) in 4f, the logic level of the PWM signal is changed to "L" at the third segment.

The confirmation circuit 318 detects the coincidence between each bit of the grayscale data and the count value to be counted. The configuration of the confirmation circuit 318 is not limited to that shown in FIG. 20. The confirmation circuit 318 may not only detect the coincidence between each bit of the grayscale data and the count value, but also detect whether or not each bit of the grayscale data and the count value is in a complementary state.

Since the voltage level of the segment waveform consists of two values, a shift of the segment waveform to the right or the left can be easily realized. As a result, deterioration of the liquid crystal due to application of a DC component can be prevented, and the influence of crosstalk can be easily reduced.

4. Configuration of Signal Driver

A detailed configuration example of the signal driver including the MLS decoder and the confirmation circuit is described below.

Figure 23:
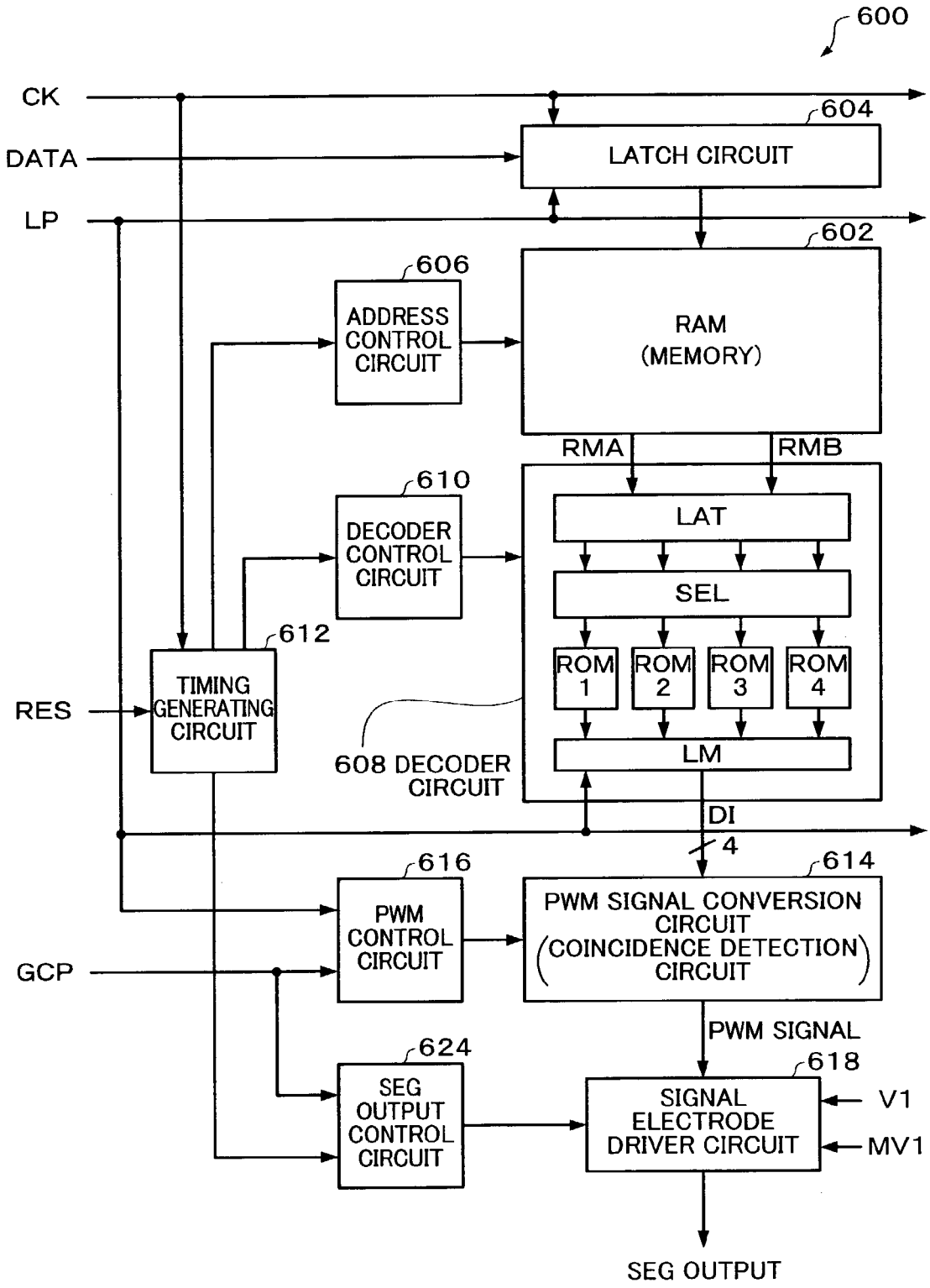
FIG. 23 is a block diagram showing a detailed example of the signal driver.

FIG. 23 shows a detailed example of the signal driver.

In FIG. 23, only a block diagram corresponding to one bit of output is illustrated in order to simplify the description.

A signal driver 600 including the MLS decoder and the confirmation circuit includes a RAM 602 which stores one frame of the grayscale data and from which the grayscale data can be read in two line units, for example.

The signal driver 600 includes a latch circuit 604. The latch circuit 604 has a function of a data capturing circuit for writing the grayscale data into the RAM 602 and a function of a line latch. A clock CK for capturing the grayscale data, grayscale data DATA, and the latch pulse LP are input to the latch circuit 604.

An address control circuit 606 controls writing of the grayscale data output from the latch circuit 604 into the RAM 602, or controls reading of the grayscale data supplied to the decoder circuit from the RAM 602.

The grayscale data read from the RAM 602 is supplied to a decoder circuit 608. As the decoder circuit 608, the configuration shown in FIG. 12 may be employed, for example. In this case, the decoder circuit 608 includes a latch circuit LAT corresponding to the latch circuit 56 shown in FIG. 12, a selector circuit SEL corresponding to the selector circuit 60 shown in FIG. 12, a line memory LM, and ROMs ROM1 to ROM4 provided in units of bits of the grayscale data and decode and output the data according to the truth table shown in FIG. 19. The decoder circuit 608 is controlled by a decoder control circuit 610. In more detail, the decoder control circuit 610 supplies the field signal shown in FIG. 9 in response to the field display timing.

The address control circuit 606 and the decoder control circuit 610 are controlled by a timing generating circuit 612. The timing generating circuit 612 specifies timing necessary for controlling reading or writing of the grayscale data and decode control timing of the grayscale data read from the RAM 602 by the field signals f1 to f4 (or field setting signals F1 and F2) corresponding to the display timing, by using the clock CK and the reset signal RES.

The decoded output of the decoder circuit 608 is supplied to a PWM signal conversion circuit 614. The PWM signal conversion circuit 614 is controlled by a PWM control circuit 616.

The PWM control circuit 616 allows the PWM signal conversion circuit 614 to specify the pulse width based on the coincidence detection results between the count value counted by the clock GCP for pulse width clocking and the MLS operation results latched by the line memory LM, for example. In this case, a count value reset by the latch pulse signal LP in one horizontal scan cycle may be used, for example.

In the case where PWM modulation in the PWM signal conversion circuit 614 is performed so that the pulse width is determined based on the coincidence detection results, if the delay of each bit of the MLS operation results cannot be ignored, the delay of each bit may be made uniform by allowing each bit of the MLS operation results to be latched by the line memory LM. Therefore, the determined pulse width does not deviate from the MLS operation results. However, if the delay of each bit of the MLS operation results input to the PWM signal conversion circuit 614 may be ignored, the line memory LM may be omitted.

A signal electrode driver circuit 618 drives the signal electrode based on the PWM signal. In this example, since two voltage levels are used in MLS drive, either the voltage level V1 or MV1 is selectively output as the SEG output.

The signal electrode driver circuit 618 is controlled by an SEG output control circuit 624. The SEG output control circuit 624 may control the signal electrode driver circuit 618 based on the display timing generated by the timing generating circuit 612 and the clock GCP.

Figure 24:
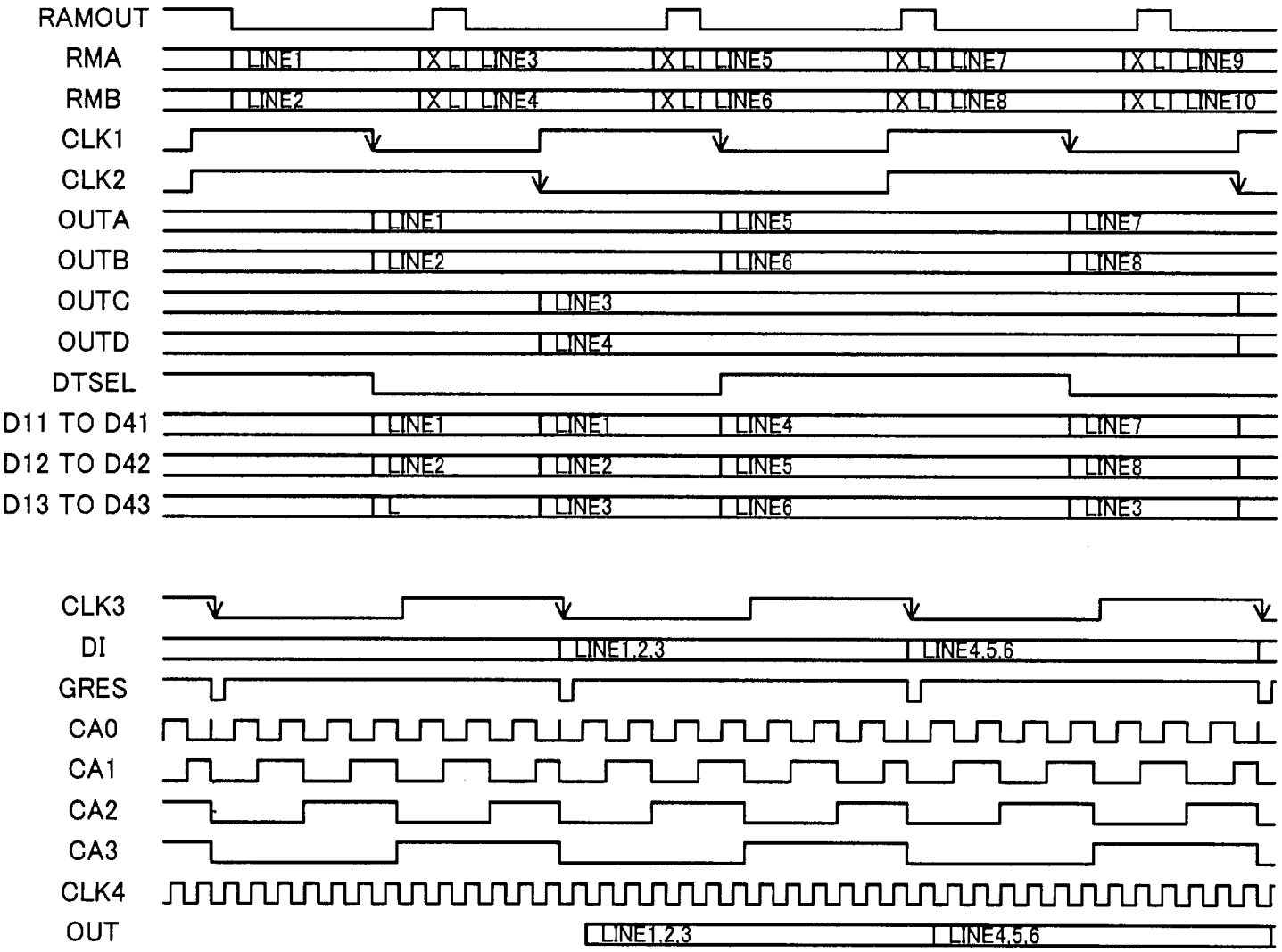
FIG. 24 is a timing chart showing an example of the entire operation timing including operation timing of the confirmation circuit of the signal driver.

FIG. 24 shows an example of a timing chart showing the operation timing of the signal driver.

FIG. 24 shows an example of the timing of signals given below in addition to the signals shown in FIG. 11. Specifically, a third clock signal CLK3 is input to the line memory LM. The decoded output signals (MLS operation results) output from the ROMs ROM1 to ROM4 are latched at a falling edge of the third clock signal CLK3. Grayscale data DI is latch output data of the line memory LM and input to the PWM signal conversion circuit 614. The reset signal GRES is the reset signal in FIG. 20. The count values CA0 to CA3 are count values for performing coincidence detection as shown FIG. 20.

The grayscale data for the consecutive three lines is selectively output by the selector circuit from among the grayscale data for four lines latched based on the first and second clock signals CLK1 and CLK2 without performing the read operation again. The MLS operation results in each field are output in bit units by using the grayscale data for three lines. The MLS operation results are then subjected to pulse width modulation.

In FIG. 24, a latch circuit (not shown) to which a fourth clock signal CLK4 is input is provided. This latch circuit has a function of allowing the input signal to pass therethrough when the logic level of the fourth clock signal CLK4 is "L", and allowing the input signal to be latched when the logic level of the fourth clock signal CLK4 is "H". Noise can be removed by outputting the PWM signal through this latch circuit.

The signal electrode driver circuit 618 outputs either the voltage level V1 or MV1 to the signal electrode based on the PWM signal generated in this manner.

The present invention is not limited to the above-described embodiments, and various modifications can be made within the scope of the invention.

As electronic equipment to which the above electro-optical device is applied, equipment for which a decrease in power consumption is strongly demanded such as a pager, watch, and a personal data assistant (PDA) is suitable in addition to the above-described portable telephone. Moreover, the electro-optical device can also be applied to a liquid crystal TV, view finder type or direct-view monitor type video tape recorder, car navigation system, calculator, word processor, work station, videophone, POS terminal, equipment provided with a touch panel, and the like.

These embodiments are described taking the case where the grayscale data is read from the display data RAM in two line units. However, the present invention is not limited thereto. The present invention may be applied to a case where it is necessary to perform two or more times of read operations from the display data RAM for generating the MLS operation results as in the case where the grayscale data is read in units of k (k<m) lines in m-line MLS.

3MLS is described in these embodiments. However, the present invention is not limited by the number of simultaneously selected lines.

These embodiments are described taking four bits of grayscale data as an example. However, the present invention is not limited by the number of bits of grayscale data.

These embodiments illustrate an example in which the signal driver includes the display data RAM. However, the present invention is not limited thereto.

What is claimed is:

1. A display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit;

wherein the first and second latch circuits retain the display data for first and second lines which is collectively read from the RAM on the falling edge of a first clock signal; and wherein the third and fourth latch circuits retain the display data for third and fourth lines which is collectively read from the RAM after the reading of the display data for the first and second lines, on the falling edge of a second clock signal obtained by dividing the first clock signal from the rising edge of the first clock signal.

2. A display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit;

wherein the first and second latch circuits retain the display data for first and second lines in a first period, and retain the display data for fifth and sixth lines in a second period;

wherein the third and fourth latch circuits retain the display data for third and fourth lines in the first period, and continuously retain the display data for the third and fourth lines in the second period;

wherein the selector circuit selectively outputs the display data for the first to third lines from among the display data for the first to fourth lines retained in the first to fourth latch circuits based on the select control signal in the first period;

wherein the selector circuit selectively outputs the display data for the fourth to sixth lines from among the display data for the third to sixth lines retained in the first to fourth latch circuits based on the select control signal in the second period;

wherein the first and second latch circuits retain the display data for first and second lines which is collectively read from the RAM on the falling edge of a first clock signal; and wherein the third and fourth latch circuits retain the display data for third and fourth lines which is collectively read from the RAM after the reading of the display data for the first and second lines, on the falling edge of a second clock signal obtained by dividing the first clock signal from the rising edge of the first clock signal.

3. The, display driver circuit as defined in claim 2, wherein:

when the number of grayscale bits of the display data is p (P is a natural number), the RAM has a group of memory cells for 2p-bit data which are disposed in the direction in which output pads connected to the signal electrodes are arranged, the width of a group of the memory cells being less than a pitch between the output pads; and at least two groups of the memory cells are arranged in a direction perpendicular to the direction in which the output pads are arranged.

4. The display driver circuit as defined in claim 1, wherein:

when the number of grayscale bits of the display data is p (p is a natural number), the RAM has a group of memory cells for 2p-bit data which are arranged in the direction in which output pads connected to the signal electrodes are arranged, the width of a group of the memory cells being less than a pitch between the output pads; and at least two groups of the memory cells are arranged in a direction perpendicular to the direction in which the output pads are arranged.

5. A display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit;

wherein, when the number of grayscale bits of the display data is p (p is a natural number), the RAM has a group of memory cells for 2p-bit data which are disposed in the direction in which output pads connected to the signal electrodes are arranged, the width of a group of the memory cells being less than a pitch between the output pads;

wherein at least two groups of the memory cells are arranged in a direction perpendicular to the direction in which the output pads are arranged;

wherein each of the memory cells has a width d in the direction in which the output pads are arranged, and the pitch between the output pads has a length L; and wherein the width of a group of the memory cells for two lines is less than the output pad pitch when the pitch has the length L ranging from 8d to 12d.

6. A display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit;

wherein the first and second latch circuits retain the display data for first and second lines in a first period, and retain the display data for fifth and sixth lines in a second period;

wherein the third and fourth latch circuits retain the display data for third and fourth lines in the first period, and continuously retain the display data for the third and fourth lines in the second period;

wherein the selector circuit selectively outputs the display data for the first to third lines from among the display data for the first to fourth lines retained in the first to fourth latch circuits based on the select control signal in the first period;

wherein the selector circuit selectively outputs the display data for the fourth to sixth lines from among the display data for the third to sixth lines retained in the first to fourth latch circuits based on the select control signal in the second period;

wherein, when the number of grayscale bits of the display data is p (p is a natural number), the RAM has a group of memory cells for 2p-bit data which are disposed in the direction in which output pads connected to the signal electrodes are arranged, the width of a group of the memory cells being less than a pitch between the output pads;

wherein at least two groups of the memory cells are arranged in a direction perpendicular to the direction in which the output pads are arranged;

wherein each of the memory cells has a width d in the direction in which the output pads are arranged, and the pitch between the output pads has a length L; and wherein the width of a group of the memory cells for two lines is less than the output pad pitch when the pitch has the length L ranging from 8d to 12d.

7. A display driver circuit which drives a plurality of signal electrodes in a display panel which also has a plurality of scan electrodes intersecting the signal electrodes by multi-line selection in which three lines are simultaneously selected, the display driver circuit comprising:

a RAM which stores display data for driving the display panel, the display data for two lines being read out at a time from the RAM;

first to fourth latch circuits which retain the display data read from the RAM;

a selector circuit which selects the display data for three consecutive lines from among the display data retained in the first to fourth latch circuits and outputs the selected display data, based on a given select control signal; and a signal electrode driver circuit which drives the signal electrodes by using given operation results based on the display data for three lines selectively output from the selector circuit;

wherein the first and second latch circuits retain the display data for first and second lines which is collectively read from the RAM on the falling edge of a first clock signal;

wherein the third and fourth latch circuits retain the display data for third and fourth lines which is collectively read from the RAM after the reading of the display data for the first and second lines, on the falling edge of a second clock signal obtained by dividing the first clock signal from the rising edge of the first clock signal;

wherein, when the number of grayscale bits of the display data is p (p is a natural number), the RAM has a group of memory cells for 2p-bit data which are arranged in the direction in which output pads connected to the signal electrodes are arranged, the width of a group of the memory cells being less than a pitch between the output pads;

wherein at least two groups of the memory cells are arranged in a direction perpendicular to the direction in which the output pads are arranged;

wherein each of the memory cells has a width d in the direction in which the output pads are arranged, and the pitch between the output pads has a length L; and wherein the width of a group of the memory cells for two lines is less than the output pad pitch when the pitch has the length L ranging from 8d to 12d.

8. The display driver circuit as defined in claim 1, further comprising:

a circuit which generates a signal having a pulse width modulated based on the operation results, wherein the signal electrode driver circuit drives the signal electrodes based on the signal having a modulated pulse width.

9. The display driver circuit as defined in claim 2, further comprising:

a circuit which generates a signal having a pulse width modulated based on the operation results, wherein the signal electrode driver circuit drives the signal electrodes based on the signal having a modulated pulse width.

10. An electro-optical device which is driven by multi-line selection in which a plurality of scan electrodes are simultaneously selected, the electro-optical device comprising:

a pixel specified by one of the scan electrodes and one of a plurality of signal electrodes intersecting the scan electrodes;

the display driver circuit as defined in claim 1 which drives the signal electrodes; and a scan driver which drives the scan electrodes.

11. An electro-optical device which is driven by multi-line selection in which a plurality of scan electrodes are simultaneously selected, the electro-optical device comprising:

a pixel specified by one of the scan electrodes and one of a plurality of signal electrodes intersecting the scan electrodes;

the display driver circuit as defined in claim 2 which drives the signal electrodes; and a scan driver which drives the scan electrodes.

12. An electro-optical device which is driven by multi-line selection in which a plurality of scan electrodes are simultaneously selected, the electro-optical device comprising:

a display panel having a pixel specified by one of the scan electrodes and one of a plurality of signal electrodes intersecting the scan electrodes;

the display driver circuit as defined in claim 1 which drives the signal electrodes; and a scan driver which drives the scan electrodes.

13. An electro-optical device which is driven by multi-line selection in which a plurality of scan electrodes are simultaneously selected, the electro-optical device comprising:

a display panel having a pixel specified by one of the scan electrodes and one of a plurality of signal electrodes intersecting the scan electrodes;

the display driver circuit as defined in claim 2 which drives the signal electrodes; and a scan driver which drives the scan electrodes.

* * * * *